US009523520B2

(12) United States Patent
Takenaka et al.

(10) Patent No.: US 9,523,520 B2
(45) Date of Patent: Dec. 20, 2016

(54) AIR-CONDITIONING APPARATUS

(75) Inventors: Naofumi Takenaka, Chiyoda-ku (JP); Shinichi Wakamoto, Chiyoda-ku (JP); Koji Yamashita, Chiyoda-ku (JP); Hiroyuki Morimoto, Chiyoda-ku (JP); Katsuhiro Ishimura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 673 days.

(21) Appl. No.: 13/997,422

(22) PCT Filed: Jan. 31, 2011

(86) PCT No.: PCT/JP2011/000518

§ 371 (c)(1),
(2), (4) Date: Jun. 24, 2013

(87) PCT Pub. No.: WO2012/104893

PCT Pub. Date: Aug. 9, 2012

(65) Prior Publication Data

US 2013/0283843 A1 Oct. 31, 2013

(51) Int. Cl.
*F25B 13/00* (2006.01)
*F25B 29/00* (2006.01)
(Continued)

(52) U.S. Cl.
CPC ..... *F25B 29/003* (2013.01); *F25B 9/006* (2013.01); *F25B 13/00* (2013.01);
(Continued)

(58) Field of Classification Search
CPC ..... F25B 9/006; F25B 13/00; F25B 29/003; F25B 2313/0231; F25B 2313/0272; F25B 2313/02741; F25B 2400/12; F25B 2400/13; F25B 2400/121
(Continued)

(56) References Cited

U.S. PATENT DOCUMENTS 5,857,349 A * 1/1999 Hamaoka et al. ..... 62/228.4
6,817,205 B1 * 11/2004 Lifson et al. ..... 62/324.1
(Continued)

FOREIGN PATENT DOCUMENTS

JP 2002 013491 1/2002
JP 2002 107002 4/2002
(Continued)

OTHER PUBLICATIONS

Machine translation for JP 2009222363.*
(Continued)

*Primary Examiner* — Ryan J Walters
*Assistant Examiner* — Joseph Trpisovsky
(74) *Attorney, Agent, or Firm* — Oblon, McClelland, Maier & Neustadt, L.L.P.

(57) ABSTRACT

An air-conditioning apparatus uses R32, a refrigerant mixture containing R32 and HFO1234yf in which R32 has a mass percentage of 40% or higher, or a refrigerant mixture containing R32 and HFO1234ze in which R32 has a mass percentage of 15% or higher, as a heat-source refrigerant. The air-conditioning apparatus includes a low-pressure shell-structure compressor, a first flow switching valve, a heat-source-side heat exchanger, first flow control devices, and plural use-side heat exchangers connected by refrigerant pipes, forming a refrigeration cycle. The compressor includes a compression chamber within a sealed container including an opening extending between inside and outside of the sealed container. The air-conditioning apparatus can perform only a heating at the use-side heat exchangers, only a cooling at the use-side heat exchangers, and a mixed cooling and heating in a mixed fashion at the use-side heat exchangers.

9 Claims, 10 Drawing Sheets

(51) Int. Cl.

| | |
|---|---|
| ***F25B 41/04*** | (2006.01) |
| ***F25B 43/00*** | (2006.01) |
| ***F25B 9/00*** | (2006.01) |

(52) U.S. Cl.
CPC ..... *F25B 2313/0231* (2013.01); *F25B 2313/0272* (2013.01); *F25B 2313/02741* (2013.01); *F25B 2400/12* (2013.01); *F25B 2400/121* (2013.01); *F25B 2400/13* (2013.01)

(58) Field of Classification Search
USPC ..... 62/324.6, 159, 160, 222, 512, 498, 504
See application file for complete search history.

(56) References Cited

U.S. PATENT DOCUMENTS

| | | | | |
|---|---|---|---|---|
| 2005/0279111 | A1* | 12/2005 | Moriwaki | 62/193 |
| 2007/0245769 | A1* | 10/2007 | Parker et al. | 62/527 |
| 2010/0132399 | A1* | 6/2010 | Mitra et al. | 62/498 |

FOREIGN PATENT DOCUMENTS

| | | |
|---|---|---|
| JP | 2003 202167 | 7/2003 |
| JP | 2004 183913 | 7/2004 |
| JP | 2009 222363 | 10/2009 |
| JP | 2009 270776 | 11/2009 |
| JP | 2010-175204 A | 8/2010 |
| JP | 2010-271011 A | 12/2010 |
| WO | 2009 154149 | 12/2009 |

OTHER PUBLICATIONS

International Search Report Issued Mar. 22, 2011 in PCT/JP11/000518 Filed Jan. 31, 2011.

Japanese Office Action issued Mar. 18, 2014 in Patent Application No. 2012-555551 with English Translation.

* cited by examiner

AIR-CONDITIONING APPARATUS

TECHNICAL FIELD

The present invention relates to air-conditioning apparatuses, particularly, to an improved air-conditioning apparatus that reduces the temperature of a refrigerant to be discharged from a compressor.

BACKGROUND ART

In view of global environmental protection in recent years, there have been discussions with regard to switching refrigerants used for air conditioning from currently-used refrigerants with a high global warming potential (GWP), such as an R410A refrigerant, an R407c refrigerant, and an R134a refrigerant, to refrigerants with a low GWP, such as a carbon-dioxide refrigerant, an ammonia refrigerant, a hydrocarbon-based refrigerant, an HFO-based refrigerant, and an R32 refrigerant. Among these low-GWP refrigerants, an R32 refrigerant has an evaporating pressure and a condensing pressure that are substantially the same as those of an R410A refrigerant, and the refrigeration capacity per unit volume is greater than that of the R410A refrigerant, thus allowing for a compact apparatus. Therefore, the R32 refrigerant or a refrigerant mixture containing, for example, an HFO refrigerant and the R32 refrigerant as a main component are favorable candidates.

However, the density of the R32 refrigerant at the suction side of a compressor is smaller than that of the R410A refrigerant, thus causing the discharge temperature of the compressor to increase. For example, when the evaporating temperature is 5 degrees C., the condensing temperature is 45 degrees C., and the degree of superheat of the refrigerant when being suctioned into the compressor is 1 degree C., the discharge temperature of the R32 refrigerant increases by about 20 degrees C., as compared with that of the R410A refrigerant. An upper limit for the discharge temperature is fixed in accordance with the guaranteed temperature of refrigerating machine oil and a seal material of the compressor. Therefore, when the R32 refrigerant or the refrigerant mixture containing, for example, the HFO refrigerant and the R32 refrigerant as a main component is used, it is necessary to provide means for reducing the discharge temperature.

Furthermore, among large-size air-conditioning apparatuses (with a rated cooling capacity of, for example, about 20 kW or greater) generally used for air-conditioning buildings, there is a type of air-conditioning apparatus that has a plurality of indoor units connected to a single outdoor unit and that can perform a cooling operation, a heating operation, and a cooling and heating mixed operation. Specifically, in the cooling operation, the indoor units only perform cooling. In the heating operation, the indoor units only perform heating. In the cooling and heating mixed operation, the indoor units perform cooling and heating in a mixed fashion at the same time. In such a large-size air-conditioning apparatus, a low-pressure-shell-type compressor having an oil reservoir, a motor, and the like are provided at the low pressure side thereof is used as the compressor so as to reduce the amount of heat radiated from the compressor and to ensure the pressure resistibility of the compressor shell. However, such a low-pressure-shell-type compressor is different from a high-pressure-shell-type compressor in that, since a liquid refrigerant is separated at the oil reservoir when the refrigerant is to be suctioned into the compressor, there is a limit to reducing the discharge temperature even if the refrigerant to be suctioned is moistened.

Thus, an air-conditioning apparatus having a refrigerant circuit that reduces the discharge temperature of a compressor by injecting a refrigerant into the compressor so as to allow for a stable (highly-reliable) operation of the compressor has been proposed (e.g. see Patent Literature 1).

CITATION LIST

Patent Literature

Patent Literature 1: Japanese Unexamined Patent Application Publication No. 2002-13491 (see p. 5 to p. 7 and p. 9, FIGS. 3 and 4)

SUMMARY OF INVENTION

Technical Problem

In the technology discussed in Patent Literature 1, the discharge temperature of the compressor is reduced by performing an injection to the compressor during the cooling operation and the heating operation, thereby allowing for the stable (highly-reliable) operation of the compressor. During the cooling operation and the heating operation, there is no large difference in the state of the refrigerant in liquid-side pipes of indoor heat exchangers and an outdoor heat exchanger, and the state of the refrigerant in an intermediate-pressure container is substantially constant.

However, during the cooling and heating mixed operation in which the indoor units perform cooling and heating in a mixed fashion at the same time, the quality and the pressure in the intermediate-pressure container may change depending on the outdoor-air temperature and the load conditions of the indoor units. When the quality and the pressure in the intermediate-pressure container change in this manner, there is a problem in that it is difficult to perform the injection stably.

An air-conditioning apparatus according to the present invention has been made to solve the aforementioned problem, and an object thereof is to provide an air-conditioning apparatus that reduces the discharge temperature of a compressor so as to allow for a stable operation of the compressor.

Solution to Problem

An air-conditioning apparatus according to the present invention uses R32, a refrigerant mixture containing R32 and HFO1234yf and in which the R32 has a mass percentage of 40% or higher, or a refrigerant mixture containing R32 and HFO1234ze and in which the R32 has a mass percentage of 15% or higher, as a heat-source refrigerant. The air-conditioning apparatus has a low-pressure shell-structure compressor, a first flow switching valve, a heat-source-side heat exchanger, a first flow control device, and a plurality of use-side heat exchangers, all of which are connected by refrigerant pipes so that a refrigeration cycle is formed. The compressor has a compression chamber that is provided within a sealed container and that has an opening extending between inside and outside of the sealed container. The air-conditioning apparatus is capable of performing a heating operation in which only heating is performed at the use-side heat exchangers, a cooling operation in which only cooling is performed at the use-side heat exchangers, and a cooling and heating mixed operation in which heating and cooling are performed in a mixed fashion at the use-side heat exchangers. The air-conditioning apparatus includes an injection pipe that connects a refrigerant circuit constituting the refrigeration cycle to the opening, and a second flow control device that is provided in the injection pipe and that controls an injection amount of refrigerant to be supplied to the compression chamber. The refrigerant circulating through the refrigeration cycle is injected into the compressor by supplying the refrigerant into the compression chamber via the injection pipe and the opening.

Advantageous Effects of Invention

The air-conditioning apparatus according to the present invention injects the refrigerant into the compression chamber from the opening via the injection pipe so as to reduce the discharge temperature of the compressor, thereby allowing for the stable operation of the compressor.

DESCRIPTION OF EMBODIMENTS

Embodiments of the present invention will be described below with reference to the drawings.

Embodiment 1

Figure 1:
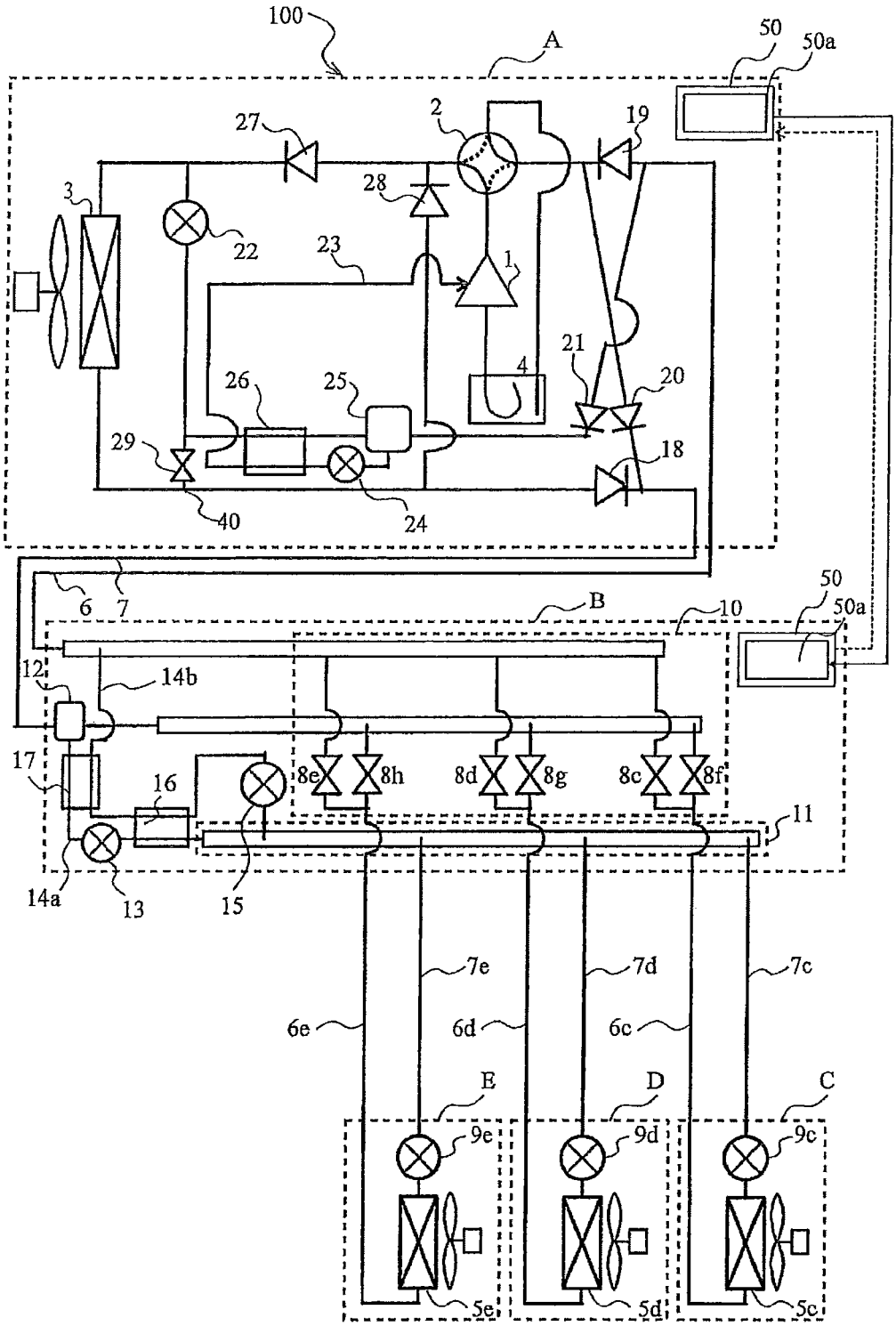
FIG. 1 is a refrigerant circuit diagram illustrating an example of a refrigerant circuit configuration of an air-conditioning apparatus according to Embodiment 1.

FIG. 1 is a refrigerant circuit diagram illustrating an example of a refrigerant circuit configuration of an air-conditioning apparatus 100 according to Embodiment 1. The refrigerant circuit configuration of the air-conditioning apparatus 100 will be described with reference to FIG. 1. The air-conditioning apparatus 100 according to Embodiment 1 has a function of reducing the temperature of a refrigerant to be discharged from a compressor so as to reduce deterioration of the refrigerant and refrigerating machine oil and fatigue in a seal material, etc. of the compressor.

Furthermore, the air-conditioning apparatus 100 is capable of executing a cooling only operation mode in which indoor units only perform a cooling operation, a heating only operation mode in which the indoor units only perform a heating operation, and a cooling and heating mixed operation mode in which the indoor units perform the cooling operation and the heating operation in a mixed fashion. The cooling and heating mixed operation mode includes a cooling main operation mode in which the cooling load is greater, and a heating main operation mode in which the heating load is greater.

As shown in FIG. 1, the air-conditioning apparatus 100 has a single heat source unit (outdoor unit) A, three indoor units C to E, and a relay unit B that is connected to the heat source unit A via a first connection pipe 6 and a second connection pipe 7 and is also connected to the indoor units C to E via first connection pipes 6*c* to 6*e* and second connection pipes 7*c* to 7*e*. Specifically, cooling energy or heating energy generated in the heat source unit A is distributed to the indoor units C to E via the relay unit B.

Although the air-conditioning apparatus 100 according to Embodiment 1 is described as being provided with a single heat source unit A, a single relay unit B, and three indoor units C to E, the numbers thereof are not limited in particular. Furthermore, in the air-conditioning apparatus 100, a heat-source refrigerant used is R32, a refrigerant mixture of R32 and HFO1234yf, or a refrigerant mixture of R32 and HFO1234ze.

Heat Source Unit A

In the heat source unit A, a compressor 1, a four-way switch valve 2, a heat-source-side heat exchanger 3, an accumulator 4, a third flow control device 22, a second flow control device 24, a third heat exchanger (heat exchanging unit) 26, a gas-liquid separator (second branch section) 25, a solenoid valve 29, an injection pipe 23, and check valves 18 to 21, 27, and 28 are connected by refrigerant pipes.

The compressor 1 suctions a refrigerant, compresses the refrigerant into a high-temperature high-pressure state, and discharges the refrigerant. The discharge side of the compressor 1 is connected to the four-way switch valve 2, and the suction side thereof is connected to the accumulator 4. The compressor 1 according to Embodiment 1 will be described as a low-pressure shell-structure compressor that has a compression chamber within a sealed container. Specifically, the compression chamber is provided with an opening (not shown) extending between the inside and the outside of the sealed container. This opening is connected to the injection pipe 23 so that the refrigerant can be supplied to the compression chamber.

During the cooling operation mode and the cooling main operation mode, the four-way switch valve 2 connects the discharge side of the compressor 1 to the check valve 27 and also connects the check valve 19 to the suction side of the accumulator 4. During the heating only operation mode and the heating main operation mode, the four-way switch valve 2 connects the discharge side of the compressor 1 to the check valve 20 and also connects the check valve 28 to the suction side of the accumulator 4.

The heat-source-side heat exchanger 3 functions as a condenser (radiator) during the cooling operation and the cooling main operation, and functions as an evaporator during the heating operation and the heating main operation. The heat-source-side heat exchanger 3 exchanges heat between air supplied from a fan provided therefor and the refrigerant so as to evaporate and gasify or condense and liquefy the refrigerant. The heat-source-side heat exchanger 3 has one side connected to the check valve 27 and the third flow control device 22, which will be described later, and the other side connected to the solenoid valve 29, the check valve 28, and the check valve 18. Although the heat-source-side heat exchanger 3 is described as being, for example, an air-cooled heat exchanger, the heat-source-side heat exchanger 3 may be of another type, such as a water-cooled type, so long as it can exchange heat between the refrigerant and another fluid.

The accumulator 4 stores an excess refrigerant produced due to differences among the cooling operation, the cooling main operation, the heating operation, and the heating main operation, that is, an excess refrigerant produced due to a transient operational change (e.g. operations of any of the indoor units C to E). During the cooling operation mode and the cooling main operation mode, the suction side of the accumulator 4 is connected to the check valve 19, and the discharge side of the accumulator 4 is connected to the suction side of the compressor 1. During the heating operation mode and the heating main operation, the suction side of the accumulator 4 is connected to the check valve 28, and the discharge side of the accumulator 4 is connected to the suction side of the compressor 1.

The check valve 18 is provided in a pipe that connects the heat-source-side heat exchanger 3 and the second connection pipe 7 and allows the refrigerant to flow only from the heat-source-side heat exchanger 3 toward the second connection pipe 7. The check valve 19 is provided in a pipe that connects the four-way switch valve 2 in the heat source unit A and the first connection pipe 6 and allows the refrigerant to flow only from the first connection pipe 6 toward the four-way switch valve 2. The check valve 20 is provided in a pipe that connects the four-way switch valve 2 in the heat source unit A and the second connection pipe 7 and allows the refrigerant to flow only from the four-way switch valve 2 toward the second connection pipe 7. The check valve 21 is provided in a pipe that connects the heat-source-side heat exchanger 3 and the first connection pipe 6 and allows the refrigerant to flow only from the first connection pipe 6 toward the heat-source-side heat exchanger 3.

The check valve 27 is provided in a pipe that connects the four-way switch valve 2 and the heat-source-side heat exchanger 3 and allows the refrigerant to flow only from the four-way switch valve 2 toward the heat-source-side heat exchanger 3. The check valve 28 is provided in a pipe that connects the second connection pipe 7 and the heat-source-side heat exchanger 3 and allows the refrigerant to flow only from the second connection pipe 7 toward the heat-source-side heat exchanger 3. The check valve 27 and the check valve 28 fix the flowing direction of the refrigerant flowing toward the heat-source-side heat exchanger 3 regardless of whether the heat-source-side heat exchanger 3 functions as an evaporator or a condenser.

The third flow control device 22 and the second flow control device 24 function as pressure-reducing valves and expansion valves and expand the refrigerant by reducing the pressure thereof. The third flow control device 22 and the second flow control device 24 may each be of a type whose opening degree is variably controllable, such as an electronic expansion valve.

The third flow control device 22 has one side connected to the third heat exchanger 26 and the solenoid valve 29 and the other side connected to the heat-source-side heat exchanger 3. The second flow control device 24 has one side connected to the gas-liquid separator 25 and the other side connected to the third heat exchanger 26.

The third flow control device 22 is closed so as to prevent the refrigerant from flowing therethrough when the heat-source-side heat exchanger 3 functions as a condenser, and is controlled so as to allow the refrigerant to flow therethrough only when the heat-source-side heat exchanger 3 functions as an evaporator. The second flow control device 24 adjusts the flow rate of refrigerant to be injected into the compressor 1 via the injection pipe 23.

The injection pipe 23 is a pipe for injecting the refrigerant flowing through the second connection pipe 7 into the compressor 1. The injection pipe 23 has one side connected to the compressor 1 and the other side connected to the third heat exchanger 26.

The gas-liquid separator (second branch section) 25 is capable of separating the refrigerant into a gas-phase refrigerant and a liquid-phase refrigerant. For example, when a two-phase gas-liquid refrigerant is supplied from the check valve 21, the gas-liquid separator 25 separates the refrigerant and causes the liquid-phase portion of the refrigerant to flow into the second flow control device 24 and the gas-phase portion to flow mainly into the third flow control device 22. The gas-liquid separator 25 is connected to the check valve 21, the third heat exchanger 26, and the second flow control device 24.

When the injection is to be performed in the cooling operation and when the injection is to be performed in the cooling main operation, the third heat exchanger 26 causes the refrigerant flowing from a first branch section 40 toward the gas-liquid separator 25 to exchange heat with the refrigerant flowing through the injection pipe 23 from the second flow control device 24 toward the compressor 1. Furthermore, when the injection is to be performed in the heating operation and when the injection is to be performed in the heating main operation, the third heat exchanger 26 causes the refrigerant flowing from the gas-liquid separator 25 toward the third flow control device 22 to exchange heat with the refrigerant flowing through the injection pipe 23 from the second flow control device 24 toward the compressor 1. Although the refrigerant is made to flow in a parallel manner when performing the injection during heating, and the refrigerant is made to flow in a countercurrent manner when performing the injection during cooling in this configuration, the flowing direction of the refrigerant may be reversed by changing the pipe connection of the heat exchangers.

The third heat exchanger 26 has one side connected to a pipe that connects the third flow control device 22 and the gas-liquid separator 25 and the other side connected to the injection pipe 23.

The solenoid valve 29 opens and closes the flow path in which the valve is provided. The solenoid valve 29 is provided in a pipe that connects the first branch section 40 and the third heat exchanger 26. The solenoid valve 29 is closed when the heat-source-side heat exchanger 3 functions as an evaporator and undergoes opening-and-closing control when the heat-source-side heat exchanger 3 functions as a condenser. The solenoid valve 29 has one side connected to the heat-source-side heat exchanger 3 and the other side connected to the third flow control device 22 and the third heat exchanger 26. The first branch section 40 may be positioned in front of or behind the check valve 18 so long as the first branch section 40 is disposed in the pipe extending from the heat-source-side heat exchanger 3 to the second connection pipe 7.

Relay Unit B

In the relay unit B, first solenoid valves 8*c* and 8*f*, second solenoid valves 8*d* and 8*g*, third solenoid valves 8*e* and 8*h*, a third branch section 10, a fourth branch section 11, a gas-liquid separator 12, a fourth flow control device 13, a first bypass pipe 14*a*, a second bypass pipe 14*b*, a fifth flow control device 15, a first heat exchanger 16, and a second heat exchanger 17 are connected by refrigerant pipes.

As shown in FIG. 1, the fourth branch section 11 and first flow control devices 9*c* to 9*e*, to be described later, are connected via the second connection pipes 7*c* to 7*e*. The diameter of the second connection pipe 7 is preferably smaller (narrower) than the diameter of the first connection pipe 6. Thus, the amount of enclosed refrigerant can be reduced.

The third branch section 10 is connected to the heat source unit A via the first connection pipe 6 and the second connection pipe 7 and is also connected to the indoor units C to E via the first connection pipes 6*c* to 6*e*, respectively. The first connection pipe 6*c* is provided with the first solenoid valves 8*c* and 8*f*, the first connection pipe 6*d* is provided with the second solenoid valves 8*d* and 8*g*, and the first connection pipe 6*e* is provided with the third solenoid valves 8*e* and 8*h*.

The third branch section 10 is connected to the first bypass pipe 14*a* and the second bypass pipe 14*b* and is also connected to the indoor units C to E via the fourth branch section 11 and the second connection pipes 7*c* to 7*e*.

The first solenoid valves 8*c* and 8*f*, the second solenoid valves 8*d* and 8*g*, and the third solenoid valves 8*e* and 8*h* open and close the respective flow paths so as to switch the connection between the first connection pipes 6*c* to 6*e* and the first connection pipe 6 or the second connection pipe 7. When the valves are connected to the first connection pipe 6, cooling is performed at the indoor units C to E. When the valves are connected to the second connection pipe 7, heating is performed at the indoor units C to E.

The fourth branch section 11 may be provided with a flow switching valve, such as a check valve. This is because the refrigerant flowing into the fourth branch section 11 via the second connection pipes 7*c* to 7*e* from any of the indoor units C to E performing the heating operation will flow into the fifth flow control device 15 and the fourth flow control device 13 via the check valve. Specifically, by making the refrigerant flow through the check valve, the refrigerant can be reliably turned into a single-phase liquid refrigerant before flowing into the fifth flow control device 15 and the fourth flow control device 13, thereby allowing for a stable flow control.

The gas-liquid separator 12 is capable of separating the refrigerant into a gas-phase refrigerant and a liquid-phase refrigerant. The gas-liquid separator 12 is connected to the second connection pipe 7, the third branch section 10, and the first bypass pipe 14*a*. The gas-liquid separator 12 has its gas-phase side connected to the third branch section 10 and its liquid-phase side connected to the fourth branch section 11 via the first bypass pipe 14*a*.

The fourth flow control device 13 and the fifth flow control device 15 function as pressure-reducing valves and expansion valves and expand the refrigerant by reducing the pressure thereof. The fourth flow control device 13 and the fifth flow control device 15 may each be of a type whose opening degree is variably controllable, such as an electronic expansion valve. The fourth flow control device 13 is connected to the first bypass pipe 14*a* extending between the second heat exchanger 17 and the first heat exchanger 16. The fifth flow control device 15 is connected to the second bypass pipe 14*b* extending between the first heat exchanger 16 and the fourth branch section 11.

The first bypass pipe 14*a* has one side connected to the gas-liquid separator 12 and the other side connected to the fourth branch section 11. The first bypass pipe 14*a* connects the downstream side of the heat-source-side heat exchanger 3 to the first flow control devices 9*c* to 9*e* when a cooled refrigerant flows toward indoor heat exchangers 5*c* to 5*e*. In the first bypass pipe 14*a*, the second heat exchanger 17, the fourth flow control device 13, and the first heat exchanger 16 are connected in that order.

The second bypass pipe 14*b* has one side connected to the first connection pipe 6 and the other side connected to the fourth branch section 11. The second bypass pipe 14*b* connects the fifth flow control device 15 to the injection pipe 23 during the heating operation and the heating main operation. In this case, the refrigerant does not travel through the first bypass pipe 14*a*. In the second bypass pipe 14*b*, the second heat exchanger 17, the first heat exchanger 16, and the fifth flow control device 15 are connected in that order.

The first heat exchanger 16 causes the refrigerant flowing through the first bypass pipe 14*a* and the refrigerant flowing through the second bypass pipe 14*b* to exchange heat with each other. One side of the first heat exchanger 16 is connected to the first bypass pipe 14*a* extending between the fourth flow control device 13 and the fourth branch section 11. The other side of the first heat exchanger 16 is connected to the second bypass pipe 14*b* extending between the second heat exchanger 17 and the fifth flow control device 15.

The second heat exchanger 17 causes the refrigerant flowing through the first bypass pipe 14*a* and the refrigerant flowing through the second bypass pipe 14*b* to exchange heat with each other. One side of the second heat exchanger 17 is connected to the first bypass pipe 14*a* extending between the gas-liquid separator 12 and the fourth flow control device 13. The other side of the second heat exchanger 17 is connected to the second bypass pipe 14*b* extending between the third branch section 10 and the first heat exchanger 16.

Indoor Units C to E

In the indoor units C to E, the first flow control devices 9*c* to 9*e* and the indoor heat exchangers 5*c* to 5*e* are connected by refrigerant pipes.

The first flow control devices 9*c* to 9*e* function as pressure-reducing valves and expansion valves and expand the refrigerant by reducing the pressure thereof. The first flow control devices 9*c* to 9*e* may each be of a type whose opening degree is variably controllable, such as an electronic expansion valve. The first flow control devices 9*c* to 9*e* have first sides connected to the second connection pipes 7*c* to 7*e* and second sides connected to the indoor heat exchangers 5*c* to 5*e*.

The indoor heat exchangers 5*c* to 5*e* function as evaporators during the cooling operation and the cooling main operation, and function as condensers (radiators) during the heating operation and the heating main operation. The indoor heat exchangers 5*c* to 5*e* exchange heat between air supplied from fans provided therefor and the refrigerant so as to evaporate and gasify or condense and liquefy the refrigerant.

The indoor heat exchangers 5*c* to 5*e* have first sides connected to the first flow control devices 9*c* to 9*e* and second sides connected to the first connection pipes 6*c* to 6*e*. Although the indoor heat exchangers 5*c* to 5*e* are described as being, for example, air-cooled heat exchangers, the indoor heat exchangers 5*c* to 5*e* may be of another type, such as a water-cooled type, so long as they can exchange heat between the refrigerant and another fluid.

Furthermore, the air-conditioning apparatus 100 is provided with control means 50. Although a detailed description of detectors will be omitted, the control means 50 can control the driving of the compressor, the switching of the four-way switch valve, the driving of a fan motor for an outdoor fan, the opening degrees of the flow control devices, the driving of fan motors for indoor fans, and so on based on information (i.e., refrigerant pressure information, refrigerant temperature information, outdoor temperature information, and indoor temperature information) detected by various detectors provided in the air-conditioning apparatus 100. The control means 50 includes a memory 50*a* that stores functions and the like for determining control values. As shown in FIG. 1, the control means 50 may be provided in each of the heat source unit A and the relay unit B or may be provided in one of the units.

Figure 2:
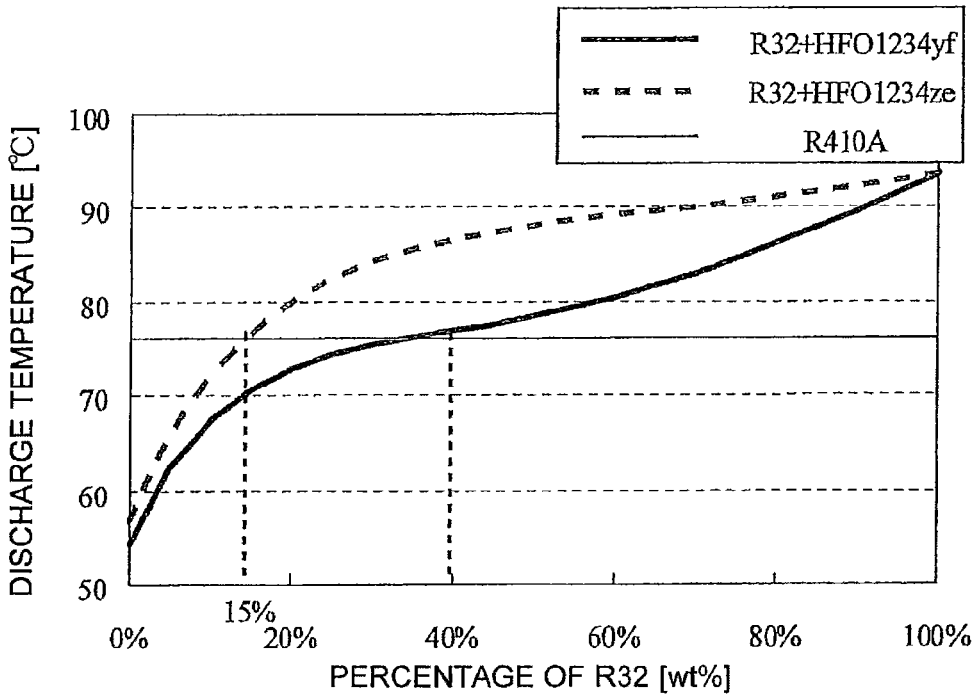
FIG. 2 illustrates the temperature of a refrigerant discharged from a compressor relative to a mixture ratio of an R32 refrigerant.

FIG. 2 illustrates the temperature of the refrigerant discharged from the compressor 1 relative to a mixture ratio of an R32 refrigerant. Specifically, a calculation result of the temperature of the refrigerant discharged from the compressor for each of R410A, a refrigerant mixture of R32 and HFO1234yf, and a refrigerant mixture of R32 and HFO1234ze is shown. At the suction side of the compressor, the evaporating temperature is assumed to be 5 degrees C., the condensing temperature is assumed to be 45 degrees C., the suction SH is assumed to be 3 degrees C., and the adiabatic efficiency of the compressor is assumed to be 65%.

Changes in the discharge temperature of the compressor 1 with respect to a refrigerant used in the air-conditioning apparatus 100 will be discussed with reference to FIG. 2. When the discharge temperature of the refrigerant increases, the refrigerating machine oil and the seal material of the compressor 1 deteriorate and the stability of the refrigerant decreases. Therefore, the discharge temperature of the refrigerant is desirably suppressed to, for example, about 120 degrees C. or lower.

If an R32 refrigerant is used alone, the discharge temperature thereof increases by about 20 degrees C., as compared with that of R410A. Although the discharge temperature does not exceed 120 degrees C. in this calculation condition, if an operation is performed with a large compression ratio of the compressor 1, such as when the heating operation is performed at a low outdoor-air temperature, there is a possibility that the discharge temperature may exceed 120 degrees C. In order to design the unit to achieve the same level of reliability as R410A based on FIG. 2, it is necessary to reduce the discharge temperature if R32 is 40 weight percent or higher in the case where the refrigerant mixture of R32 and HFO1234yf is used, or if R32 is 15 weight percent or higher in the case where the refrigerant mixture of R32 and HFO1234yf is used. If an increase by about 5 degrees C. relative to R410A is allowed, it is necessary to reduce the discharge temperature if R32 is 60 weight percent or higher in the case where the refrigerant mixture of R32 and HFO1234yf is used, or if R32 is 25 weight percent or higher in the case where the refrigerant mixture of R32 and HFO1234yf is used.

In the case where a low-pressure shell-structure compressor is used, there is a limit to reducing the discharge temperature even if the refrigerant at the suction side of the compressor 1 is moistened. Therefore, it is effective to reduce the temperature of the refrigerant to be discharged from the compressor 1 by performing an injection to the compressor 1.

Next, the operation during the various operation modes executed by the air-conditioning apparatus 100 according to Embodiment 1 will be described. The operation of the air-conditioning apparatus 100 includes four modes, which are the cooling operation, the heating operation, and the cooling main operation and the heating main operation included in the cooling and heating mixed operation.

The cooling operation is an operation mode in which the indoor units C to E are only capable of performing cooling and are either performing cooling or stopped. The heating operation is an operation mode in which the indoor units C to E are only capable of performing heating and are either performing heating or stopped.

The cooling main operation is a cooling and heating mixed operation mode in which cooling or heating is selectable in each of the indoor units C to E and the cooling load is greater than the heating load. In this operation mode, the heat-source-side heat exchanger 3 is connected to the discharge side of the compressor 1 and functions as a condenser (radiator).

The heating main operation is a cooling and heating mixed operation mode in which cooling or heating is selectable in each of the indoor units and the heating load is greater than the cooling load. In this operation mode, the heat-source-side heat exchanger 3 is connected to the suction side of the compressor 1 and functions as an evaporator. The flow of the refrigerant when the injection is performed or not performed in each of the operation modes will be described below together with P-h diagrams.

When Injection is not Performed During Cooling Only Operation

Figure 3:
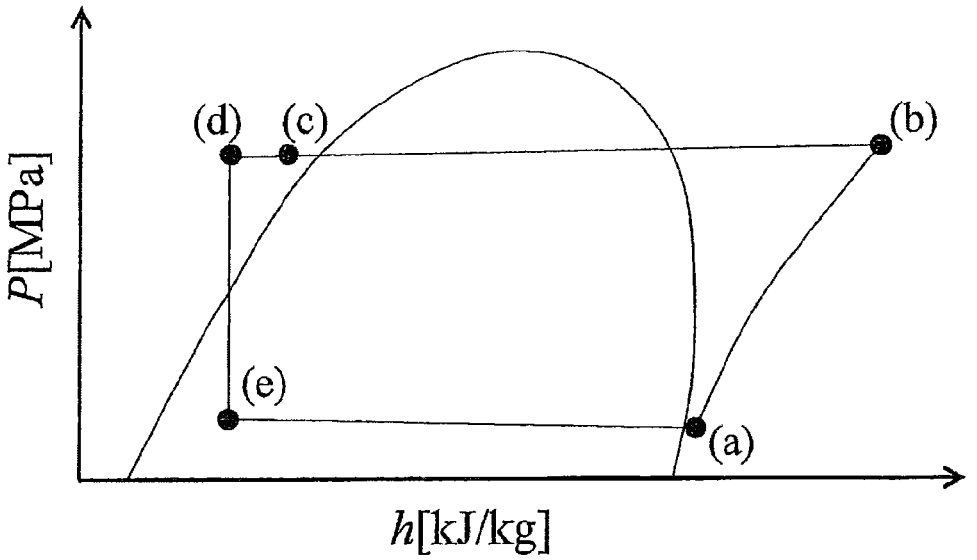
FIG. 3 is a P-h diagram corresponding to a case where an injection is not performed during a cooling only operation of the air-conditioning apparatus shown in FIG. 1.

FIG. 3 is a P-h diagram corresponding to a case where the injection is not performed during the cooling only operation of the air-conditioning apparatus 100 shown in FIG. 1. The following description based on FIGS. 1 and 3 relates to the case where the injection is not performed during the cooling only operation. In this case, all of the indoor units C to E perform cooling. When performing the cooling only operation, the four-way switch valve 2 is switched so as to cause the refrigerant discharged from the compressor 1 to flow into the heat-source-side heat exchanger 3. The first solenoid valve 8*c*, the second solenoid valve 8*d*, and the third solenoid valve 8*e* are opened, whereas the first solenoid valve 8*f*, the second solenoid valve 8*g*, and the third solenoid valve 8*h* are closed. The third flow control device 22 is completely closed so that the refrigerant does not flow therethrough, and the solenoid valve 29 is closed. In this state, the operation of the compressor 1 commences.

A low-temperature low-pressure gas refrigerant is compressed by the compressor 1 and is discharged therefrom as a high-temperature high-pressure gas refrigerant. The refrigerant compression process in the compressor 1 involves compressing the refrigerant such that the refrigerant is heated more than when the refrigerant is adiabatically compressed based on an isentropic line by the adiabatic efficiency of the compressor, and is expressed by a line extending from point (a) to point (b) in FIG. 3.

The high-temperature high-pressure gas refrigerant discharged from the compressor 1 flows into the heat-source-side heat exchanger 3 via the four-way switch valve 2 and the check valve 27. In this case, the refrigerant is cooled while heating outdoor air, thereby becoming an intermediate-temperature high-pressure liquid refrigerant. The change in the state of the refrigerant at the heat-source-side heat exchanger 3 is expressed by a slightly-slanted substantially horizontal line extending from point (b) to point (c) in FIG. 3 in view of pressure loss in the heat-source-side heat exchanger 3.

The intermediate-temperature high-pressure liquid refrigerant flowing out of the heat-source-side heat exchanger 3 flows into the first bypass pipe 14*a* via the second connection pipe 7 and the gas-liquid separator 12. Then, the refrigerant flowing into the first bypass pipe 14*a* travels through the second heat exchanger 17, the fourth flow control device 13, and the first heat exchanger 16. In this case, the refrigerant flowing into the first bypass pipe 14*a* is cooled by exchanging heat with the refrigerant flowing through the second bypass pipe 14*b* at the first heat exchanger 16 and the second heat exchanger 17. The cooling process is expressed by a line extending from point (c) to point (d) in FIG. 3.

The liquid refrigerant cooled at the first heat exchanger 16 and the second heat exchanger 17 flows into the fourth branch section 11 while a portion of the refrigerant is made to bypass through the second bypass pipe 14*b*. The high-pressure liquid refrigerant flowing into the fourth branch section 11 is diverted at the fourth branch section 11 so as to flow into the first flow control devices 9*c* to 9*e*. Then, the high-pressure liquid refrigerant is expanded and reduced in pressure by the first flow control devices 9*c* to 9*e*, thereby turning into a low-temperature low-pressure two-phase gas-liquid state. The state of the refrigerant is changed at the first flow control devices 9*c* to 9*e* under fixed enthalpy. The change in the state of the refrigerant in this case is expressed by a vertical line extending from point (d) to point (e) in FIG. 3.

The low-temperature low-pressure two-phase gas-liquid refrigerant flowing out of the first flow control devices 9*c* to 9*e* flows into the indoor heat exchangers 5*c* to 5*e*. Then, the refrigerant is heated while cooling indoor air, thereby becoming a low-temperature low-pressure gas refrigerant. The change in the state of the refrigerant at the indoor heat exchangers 5*c* to 5*e* is expressed by a slightly-slanted substantially horizontal line extending from point (e) to point (a) in FIG. 3 in view of pressure loss.

The low-temperature low-pressure gas refrigerant flowing out of the indoor heat exchangers 5*c* to 5*e* travels through the solenoid valves 8*c* to 8*e* and merges at the third branch section 10. The low-temperature low-pressure gas refrigerant merging at the third branch section 10 merges with a low-temperature low-pressure gas refrigerant heated at the second heat exchanger 17 and the first heat exchanger 16 in the second bypass pipe 14*b*. Then, the refrigerant flows into the compressor 1 via the first connection pipe 6, the four-way switch valve 2, and the accumulator 4 and is compressed.

When Injection is Performed During Cooling Only Operation

Figure 4:
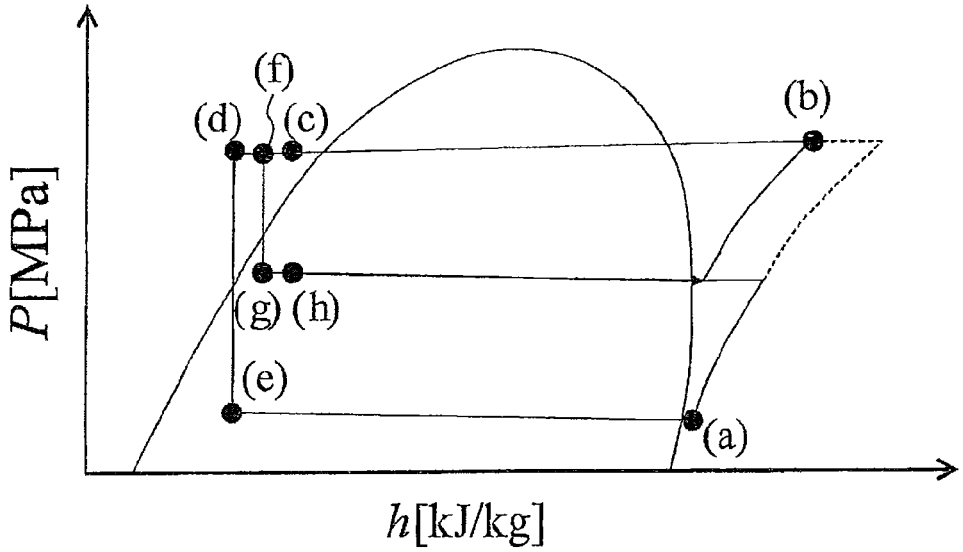
FIG. 4 is a P-h diagram corresponding to a case where the injection is performed during the cooling only operation of the air-conditioning apparatus shown in FIG. 1.

FIG. 4 is a P-h diagram corresponding to a case where the injection is performed during the cooling only operation of the air-conditioning apparatus 100 shown in FIG. 1. The following description based on FIGS. 1 and 4 relates to the case where the injection is performed during the cooling only operation. The movement of the refrigerant when the temperature of the refrigerant to be discharged from the compressor 1 may increase, unless an injection is performed, due to an increase in refrigerant compression ratio caused by, for example, a high outdoor-air temperature or a low indoor temperature will be described. When performing the injection during the cooling operation, the solenoid valve 29 is opened. Because the flow of the mainstream refrigerant is similar to that when the injection is not performed during the cooling operation, a description thereof will be omitted.

In order to reduce the discharge temperature of the refrigerant, a portion of liquid refrigerant cooled at the heat-source-side heat exchanger 3 is made to flow into the third heat exchanger 26 via the solenoid valve 29. The refrigerant flowing into the third heat exchanger 26 is cooled by exchanging heat with a low-temperature refrigerant, to be described later. The change in the state of the refrigerant in this case is expressed by a line extending from point (c) to point (f) in FIG. 4. Furthermore, this cooled refrigerant flows into the second flow control device 24 via the gas-liquid separator 25 and is reduced in pressure, and then flows into the third heat exchanger 26. The change in the state of the refrigerant in this case is expressed by a line extending from point (f) to point (g) in FIG. 4. The refrigerant flowing into the third heat exchanger 26 is heated by exchanging heat with the aforementioned high-temperature refrigerant. The change in the state of the refrigerant in this case is expressed by a line extending from point (g) to point (h) in FIG. 4.

The cooled two-phase gas-liquid refrigerant flowing out of the third heat exchanger 26 is injected into the compressor 1. Thus, the flow rate of the refrigerant in the compressor 1 increases so that the cooling capacity increases. In addition, the discharge temperature of the compressor 1 is reduced.

When a two-phase gas-liquid refrigerant flows into the flow control device 24, a large pressure fluctuation may occur due to the gas and the liquid alternately flowing into the flow control device 24. However, in the air-conditioning apparatus 100 according to Embodiment 1, since the refrigerant flowing into the third heat exchanger 26 via the solenoid valve 29 is cooled at the third heat exchanger 26, the refrigerant flowing into the flow control device 24 is a single-phase liquid refrigerant. In other words, since a single-phase liquid refrigerant flows into the flow control device 24, the occurrence of a pressure fluctuation is suppressed. Specifically, the flow control device 24 can perform stable flow control on the refrigerant.

The air-conditioning apparatus 100 according to Embodiment 1 reduces the discharge temperature of the compressor 1 by performing the injection to the compressor 1 during the cooling only operation in this manner so as to reduce deterioration of the refrigerant and the refrigerating machine oil and fatigue in the seal material, etc. of the compressor 1, thereby allowing for a stable (highly-reliable) operation of the compressor 1.

Figure 5:
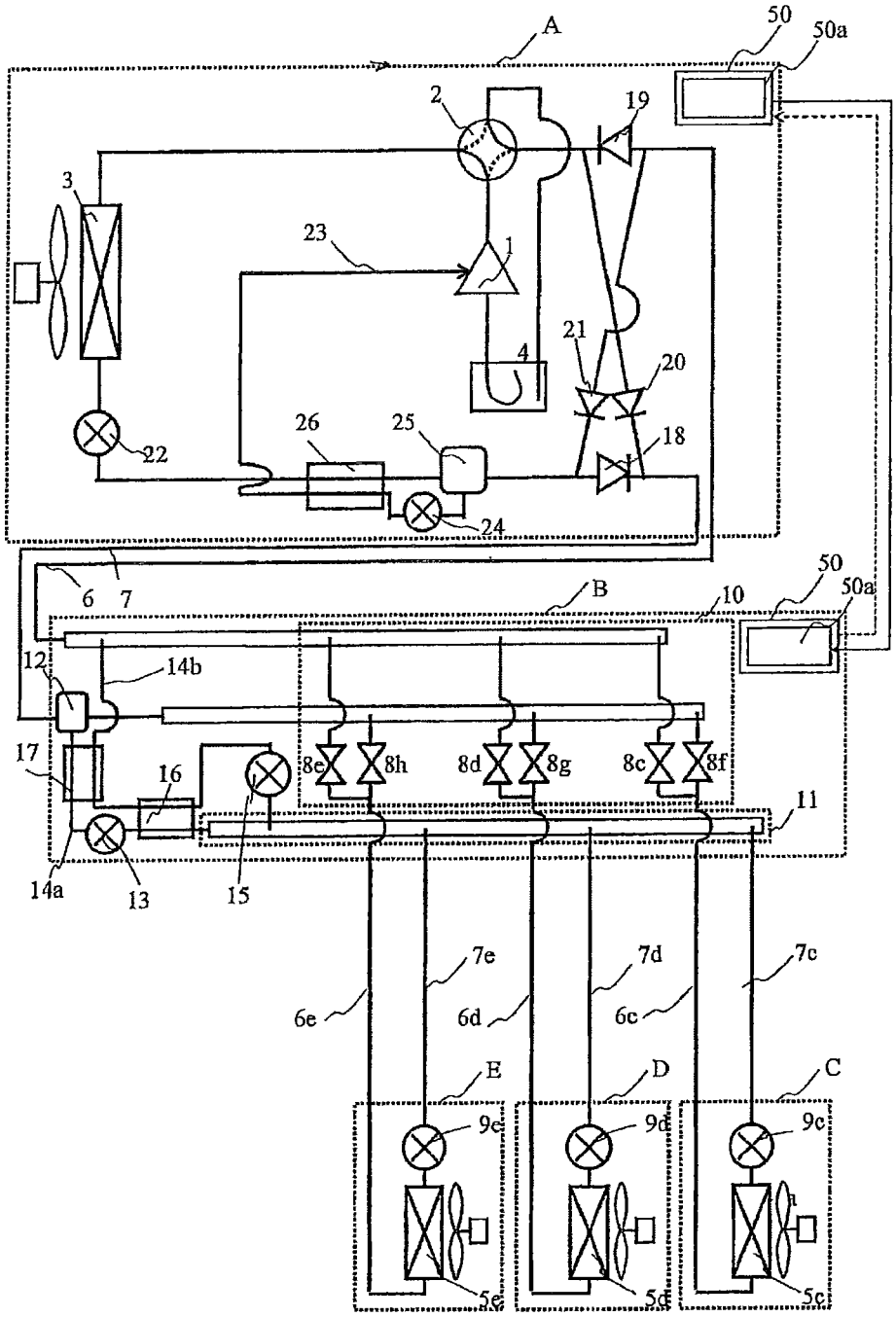
FIG. 5 illustrates an example of a refrigerant circuit configuration that is different from the refrigerant circuit configuration shown in FIG. 1 and that is capable of performing the injection during cooling and heating.

FIG. 5 illustrates an example of a refrigerant circuit configuration that is different from the refrigerant circuit configuration shown in FIG. 1 and that is capable of performing the injection during cooling and heating. As a refrigerant circuit configuration, the circuit shown in FIG. 5 can perform an injection operation. However, in the refrigerant circuit configuration shown in FIG. 5, the refrigerant travels through the third flow control device 22 during the cooling only operation and the cooling main operation. Thus, the refrigerant may possibly foam due to pressure loss by the third flow control device 22.

In contrast, the air-conditioning apparatus 100 according to Embodiment 1 employs the refrigerant circuit configuration shown in FIG. 1 so that the refrigerant does not travel through the third flow control device 22 during the cooling only operation and the cooling main operation. Consequently, a high-pressure liquid refrigerant is directly injected into the compressor 1, thereby allowing for a stable injection.

When Injection is not Performed During Heating Only Operation

Figure 6:
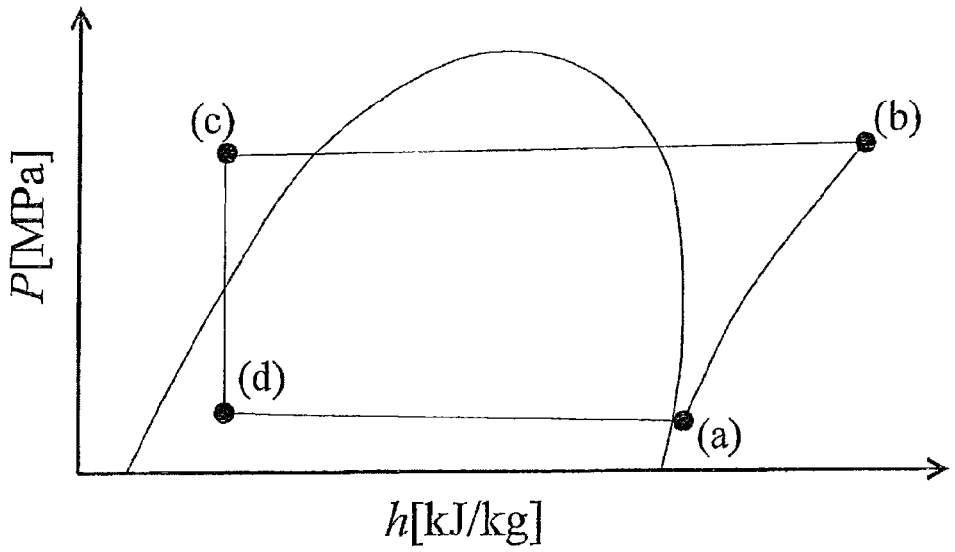
FIG. 6 is a P-h diagram corresponding to a case where the injection is not performed during a heating only operation of the air-conditioning apparatus shown in FIG. 1.

FIG. 6 is a P-h diagram corresponding to a case where the injection is not performed during the heating only operation of the air-conditioning apparatus shown in FIG. 1. The following description based on FIGS. 1 and 6 relates to the case where the injection is not performed during the heating only operation. In this case, all of the indoor units C to E perform heating. When performing the heating operation, the four-way switch valve 2 is switched so as to cause the refrigerant discharged from the compressor 1 to flow into the third branch section 10. The first solenoid valve 8*c*, the second solenoid valve 8*d*, and the third solenoid valve 8*e* are closed, whereas the first solenoid valve 8*f*, the second solenoid valve 8*g*, and the third solenoid valve 8*h* are opened. The solenoid valve 29 is closed. In this state, the operation of the compressor 1 commences.

A low-temperature low-pressure gas refrigerant is compressed by the compressor 1 and is discharged therefrom as a high-temperature high-pressure gas refrigerant. The refrigerant compression process in the compressor 1 is expressed by a line extending from point (a) to point (b) in FIG. 6.

The high-temperature high-pressure gas refrigerant discharged from the compressor 1 flows into the third branch section 10 via the four-way switch valve 2, the second connection pipe 7, and the gas-liquid separator 12. The high-temperature high-pressure gas refrigerant flowing into the third branch section 10 is diverted at the third branch section 10 so as to flow into the indoor heat exchangers 5*c* to 5*e* via the solenoid valves 8*f* to 8*h*. Then, the refrigerant is cooled while heating indoor air, thereby becoming an intermediate-temperature high-pressure liquid refrigerant. The change in the state of the refrigerant at the indoor heat exchangers 5*c* to 5*e* is expressed by a slightly-slanted substantially horizontal line extending from point (b) to point (c) in FIG. 6.

The intermediate-temperature high-pressure liquid refrigerant flowing out of the indoor heat exchangers 5*c* to 5*e* merges at the fourth branch section 11 via the first flow control devices 9*c* to 9*e* and then flows into the third flow control device 22 via the fifth flow control device 15, the first heat exchanger 16, the second heat exchanger 17, the first connection pipe 6, the check valve 21, the gas-liquid separator 25, and the third heat exchanger 26. In this case, the high-pressure liquid refrigerant flowing out of the indoor heat exchangers 5*c* to 5*e* is expanded and reduced in pressure by the first flow control devices 9*c* to 9*e*, the fifth flow control device 15, and the third flow control device 22, thereby turning into a low-temperature low-pressure two-phase gas-liquid state. The change in the state of the refrigerant in this case is expressed by a vertical line extending from point (c) to point (d) in FIG. 6.

The low-temperature low-pressure two-phase gas-liquid refrigerant flowing out of the third flow control device 22 flows into the heat-source-side heat exchanger 3 where the refrigerant is heated while cooling outdoor air, thereby becoming a low-temperature low-pressure gas refrigerant. The change in the state of the refrigerant at the heat-source-side heat exchanger 3 is expressed by a slightly-slanted substantially horizontal line extending from point (d) to point (a) in FIG. 6. The low-temperature low-pressure gas refrigerant flowing out of the heat-source-side heat exchanger 3 flows into the compressor 1 via the check valve 28, the four-way switch valve 2, and the accumulator 4 and is compressed.

When Injection is Performed During Heating Only Operation

Figure 7:
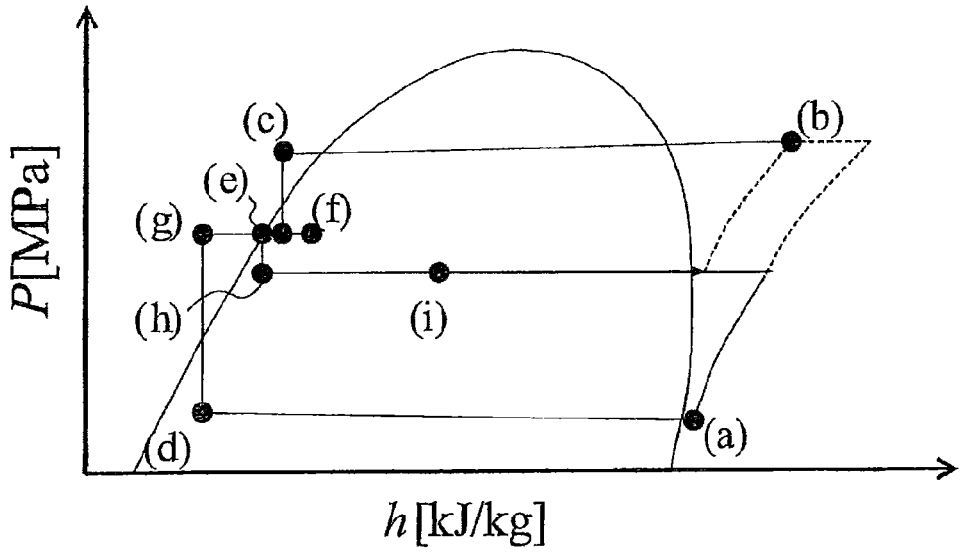
FIG. 7 is a P-h diagram corresponding to a case where the injection is performed during the heating only operation of the air-conditioning apparatus shown in FIG. 1.

FIG. 7 is a P-h diagram corresponding to a case where the injection is performed during the heating only operation of the air-conditioning apparatus 100 shown in FIG. 1. The following description based on FIGS. 1 and 7 relates to the case where the injection is performed during the heating only operation. The movement of the refrigerant when the discharge temperature may increase, unless an injection is performed, due to an increase in refrigerant compression ratio caused by, for example, a low outdoor-air temperature or a high indoor temperature will be described. In this case, the solenoid valve 29 is closed. Because the flow of the mainstream refrigerant is basically similar to that when the injection is not performed, a description thereof will be omitted.

When the injection is not performed during the heating operation, the expansion balance between the fifth flow control device 15 and the third flow control device 22 is arbitrary. On the other hand, when the injection is to be performed during the heating operation, the pressure of refrigerant to be injected may be increased so as to allow for easier flow adjustment. Therefore, for example, the fifth flow control device 15 may be completely opened, and the flow rate of refrigerant flowing into the heat-source-side heat exchanger 3 may be adjusted by mainly adjusting the third flow control device 22 so that a difference between the pressure at the discharge side of the compressor 1 and the pressure at the outlet of the fifth flow control device 15 is, for example, about 1 MPa or lower.

In this case, with regard to a two-phase gas-liquid refrigerant flowing into the gas-liquid separator 25 after circulating through the indoor units C to E, a portion of the refrigerant is diverted mainly in a liquid refrigerant state from the lower part of the gas-liquid separator 25 (point (e) in FIG. 7), whereas the remaining portion of the refrigerant flows out of another outlet (point (f)). The mainstream refrigerant (point (f)) is cooled at the third heat exchanger 26 (point (g)), is reduced in pressed by the third flow control device 22 (point (d)), and then flows into the heat-source-side heat exchanger 3.

On the other hand, the diverted liquid refrigerant (point (e)) is reduced in pressure by the flow control device 24 (point (h)), is heated at the third heat exchanger 26 (point (i)), and is injected into the compressor 1. By injecting a two-phase gas-liquid refrigerant into the compressor 1, the flow rate of the refrigerant increases so that the heating capacity increases. Moreover, the discharge temperature of the compressor 1 is reduced. Because the liquid refrigerant is diverted at the gas-liquid separator 25, the refrigerant flowing into the second flow control device 24 is a single-phase liquid refrigerant, and the refrigerant flowing into the third flow control device 22 is cooled at the third heat exchanger 26 so as to become a single-phase liquid refrigerant. In other words, since a single-phase liquid refrigerant flows into the second flow control device 24 and the third flow control device 22, the occurrence of a pressure fluctuation is suppressed. Specifically, the second flow control device 24 and the third flow control device 22 can perform stable flow control on the refrigerant.

The air-conditioning apparatus 100 according to Embodiment 1 reduces the discharge temperature of the compressor 1 by performing the injection to the compressor 1 during the heating only operation in this manner so as to reduce deterioration of the refrigerant and the refrigerating machine oil and fatigue in the seal material, etc. of the compressor 1, thereby allowing for the stable (highly-reliable) operation of the compressor 1. Furthermore, during the heating only operation, the refrigerant is controlled to an intermediate pressure by being made to travel through the third flow control device 22. Then, the intermediate-pressure refrigerant is injected into the compressor 1, thereby allowing for the stable injection.

When Injection is not Performed During Cooling Main Operation

Figure 8:
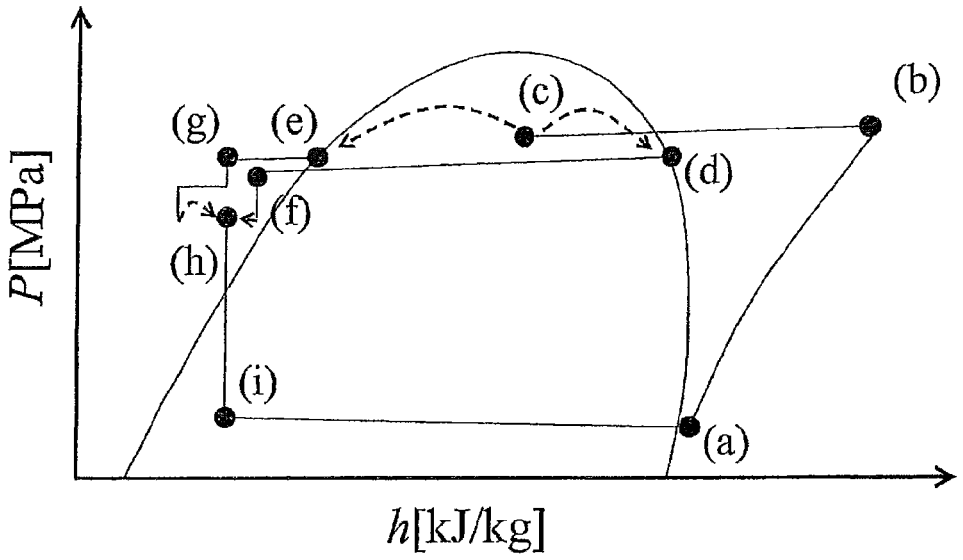
FIG. 8 is a P-h diagram corresponding to a case where the injection is not performed during a cooling main operation of the air-conditioning apparatus shown in FIG. 1.

FIG. 8 is a P-h diagram corresponding to a case where the injection is not performed during the cooling main operation of the air-conditioning apparatus shown in FIG. 1. The following description based on FIGS. 1 and 8 relates to the case where the injection is not performed during the cooling main operation. In this case, the indoor units C and D perform cooling, whereas the indoor unit E performs heating. When performing the cooling main operation, the four-way switch valve 2 is switched so as to cause the refrigerant discharged from the compressor 1 to flow into the heat-source-side heat exchanger 3. The first solenoid valve 8*c*, the second solenoid valve 8*d*, and the third solenoid valve 8*h* are opened, whereas the first solenoid valve 8*f*, the second solenoid valve 8*g*, and the third solenoid valve 8*e* are closed. The third flow control device 22 is completely closed so that the refrigerant does not flow therethrough, and the solenoid valve 29 is closed. In this state, the operation of the compressor 1 commences.

A low-temperature low-pressure gas refrigerant is compressed by the compressor 1 and is discharged therefrom as a high-temperature high-pressure gas refrigerant. The refrigerant compression process in the compressor 1 is expressed by a line extending from point (a) to point (b) in FIG. 8.

The high-temperature high-pressure gas refrigerant discharged from the compressor 1 flows into the heat-source-side heat exchanger 3 via the four-way switch valve 2. In this case, the refrigerant is cooled while heating outdoor air at the heat-source-side heat exchanger 3 while still leaving an amount of heat required for heating, thereby turning into an intermediate-temperature high-pressure two-phase gas-liquid state. The change in the state of the refrigerant at the heat-source-side heat exchanger 3 is expressed by a slightly-slanted substantially horizontal line extending from point (b) to point (c) in FIG. 8.

The intermediate-temperature high-pressure two-phase gas-liquid refrigerant flowing out of the heat-source-side heat exchanger 3 flows into the gas-liquid separator 12 via the second connection pipe 7. In the gas-liquid separator 12, the refrigerant is separated into a gas refrigerant (point (d)) and a liquid refrigerant (point (e)).

The gas refrigerant (point (d)) separated by the gas-liquid separator 12 flows into the indoor heat exchanger 5*e*, which performs heating, via the third branch section 10 and the solenoid valve 8*h*. Then, the refrigerant is cooled while heating indoor air, thereby becoming an intermediate-temperature high-pressure gas refrigerant. The change in the state of the refrigerant at the indoor heat exchanger 5*e* is expressed by a slightly-slanted substantially horizontal line extending from point (d) to point (f) in FIG. 8. The refrigerant (point (f)) flowing out of the indoor heat exchanger 5*e* performing heating flows into the fourth branch section 11 via the first flow control device 9*e* and the second connection pipe 7*e*.

On the other hand, the liquid refrigerant (point (e)) separated by the gas-liquid separator 12 flows into the first bypass pipe 14*a*. Then, the liquid refrigerant flowing into the first bypass pipe 14*a* flows into the second heat exchanger 17. The liquid refrigerant flowing into the second heat exchanger 17 is cooled by exchanging heat with a low-pressure refrigerant flowing through the second bypass pipe 14*b*. The change in the state of the refrigerant at the second heat exchanger 17 is expressed by a substantially horizontal line extending from point (e) to point (g) in FIG. 8. Then, the refrigerant (point (g)) flowing out of the second heat exchanger 17 flows into the fourth branch section 11 via the fourth flow control device 13 and the first heat exchanger 16 and merges with the refrigerant flowing from the second connection pipe 7*e* (point (h)).

The merged high-pressure liquid refrigerant flows into the first flow control devices 9*c* and 9*d* of the indoor units C and D, which perform cooling, from the fourth branch section 11 while a portion of the refrigerant is made to bypass through the second bypass pipe 14*b*. Then, the high-pressure liquid refrigerant is expanded and reduced in pressure by the first flow control devices 9*c* and 9*d*, thereby turning into a low-temperature low-pressure two-phase gas-liquid state. The state of the refrigerant is changed at the first flow control devices 9*c* and 9*d* under fixed enthalpy. The change in the state of the refrigerant in this case is expressed by a vertical line extending from point (h) to point (i) in FIG. 8.

The low-temperature low-pressure two-phase gas-liquid refrigerant flowing out of the first flow control devices 9*c* and 9*d* flows into the indoor heat exchangers 5*c* and 5*d*, which perform cooling. Then, the refrigerant is heated while cooling indoor air, thereby becoming a low-temperature low-pressure gas refrigerant. The change in the state of the refrigerant at the indoor heat exchangers 5*c* and 5*d* is expressed by a slightly-slanted substantially horizontal line extending from point (i) to point (a) in FIG. 8.

The low-temperature low-pressure gas refrigerant flowing out of the indoor heat exchangers 5*c* and 5*d* travels through the solenoid valves 8*c* and 8*d* and merges at the third branch section 10. The low-temperature low-pressure gas refrigerant merging at the third branch section 10 merges with the low-temperature low-pressure gas refrigerant flowing from the second bypass pipe 14*b*. In this case, the refrigerant flowing from the second bypass pipe 14*b* has been heated at the second heat exchanger 17 and the first heat exchanger 16 by the liquid refrigerant flowing through the first bypass pipe 14*a*.

The low-temperature low-pressure gas refrigerant flowing out of the third branch section 10 flows into the compressor 1 via the first connection pipe 6, the four-way switch valve 2, and the accumulator 4 and is compressed.

When Injection is Performed During Cooling Main Operation

Figure 9:
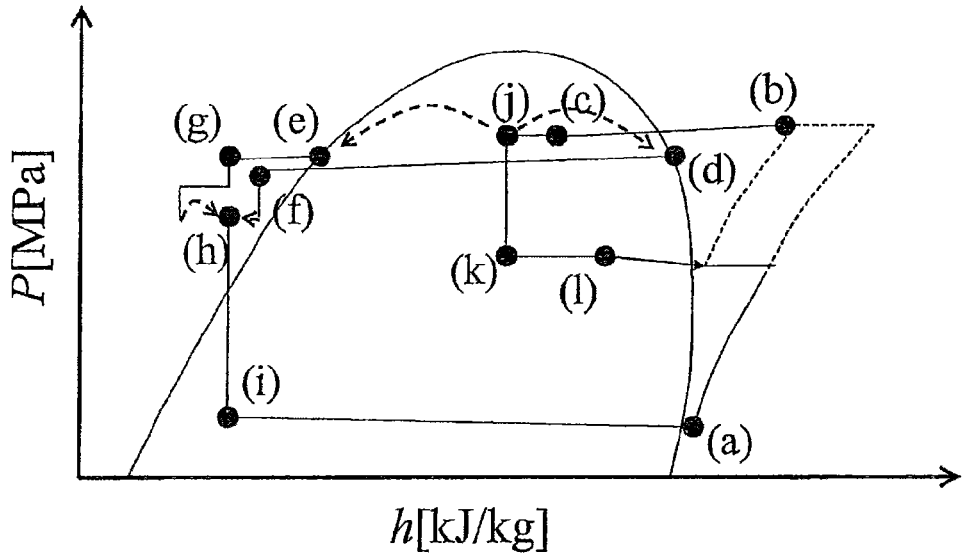
FIG. 9 is a P-h diagram corresponding to a case where the injection is performed during the cooling main operation of the air-conditioning apparatus shown in FIG. 1.

FIG. 9 is a P-h diagram corresponding to a case where the injection is performed during the cooling main operation of the air-conditioning apparatus shown in FIG. 1. The following description based on FIGS. 1 and 9 relates to the case where the injection is performed during the cooling main operation. The movement of the refrigerant when the discharge temperature may increase, unless an injection is performed, due to an increase in refrigerant compression ratio will be described. When performing the injection during the cooling main operation, the solenoid valve 29 is opened. Because the flow of the mainstream refrigerant is basically similar to that when the injection is not performed, a description thereof will be omitted.

In order to reduce the discharge temperature of the refrigerant, a portion of liquid refrigerant cooled at the heat-source-side heat exchanger 3 is made to flow into the third heat exchanger 26 via the solenoid valve 29. The refrigerant flowing into the third heat exchanger 26 is cooled (point (j) in FIG. 9) by exchanging heat with a low-temperature refrigerant, to be described later, is reduced in pressure (point (k)) by the flow control device 24 via the gas-liquid separator 25, and is heated (point (l)) at the third heat exchanger 26.

The cooled two-phase gas-liquid refrigerant flowing out of the third heat exchanger 26 is injected into the compressor 1. Thus, the flow rate of the refrigerant in the compressor 1 increases so that the cooling capacity increases. In addition, the discharge temperature of the compressor 1 is reduced. When a two-phase gas-liquid refrigerant flows into the flow control device 24, a large pressure fluctuation may occur due to the gas and the liquid alternately flowing into the flow control device 24. However, in the air-conditioning apparatus 100 according to Embodiment 1, since the refrigerant flowing into the third heat exchanger 26 via the solenoid valve 29 is cooled at the third heat exchanger 26, the refrigerant flowing into the flow control device 24 is a single-phase liquid refrigerant. In other words, since a single-phase liquid refrigerant flows into the flow control device 24, the occurrence of a pressure fluctuation is suppressed. Specifically, the flow control device 24 can perform stable flow control on the refrigerant.

The air-conditioning apparatus 100 according to Embodiment 1 reduces the discharge temperature of the compressor 1 by performing the injection to the compressor 1 during the cooling main operation in this manner so as to reduce deterioration of the refrigerant and the refrigerating machine oil and fatigue in the seal material, etc. of the compressor 1, thereby allowing for the stable (highly-reliable) operation of the compressor 1. Furthermore, during the cooling main operation, the refrigerant does not flow through the third flow control device 22, as in the cooling operation. Similar to the cooling only operation, a high-pressure liquid refrigerant is directly injected into the compressor 1, thereby allowing for the stable injection.

When Injection is not Performed During Heating Main Operation

Figure 10:
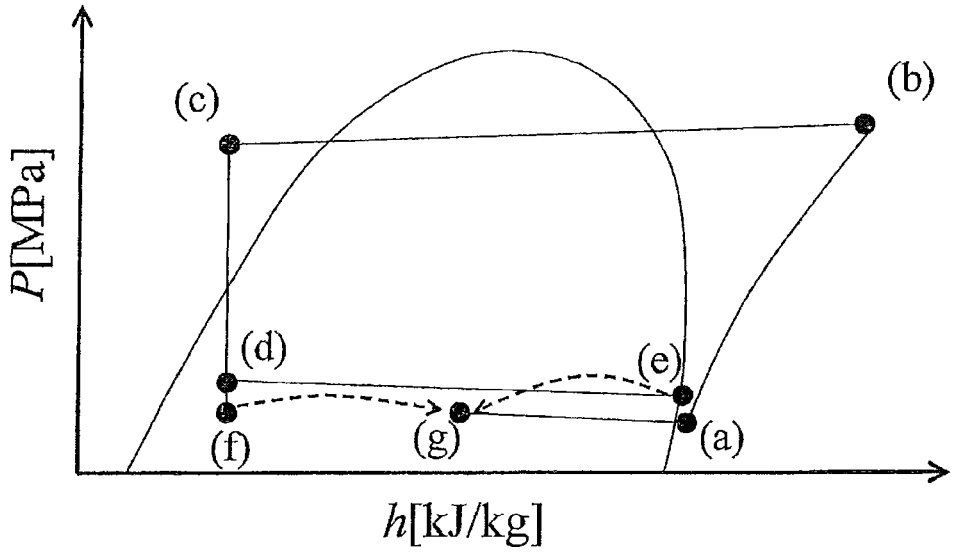
FIG. 10 is a P-h diagram corresponding to a case where the injection is not performed during a heating main operation of the air-conditioning apparatus shown in FIG. 1.

FIG. 10 is a P-h diagram corresponding to a case where the injection is not performed during the heating main operation of the air-conditioning apparatus 100 shown in FIG. 1. The following description based on FIGS. 1 and 10 relates to the case where the injection is not performed during the heating main operation. In this case, the indoor unit C performs cooling, whereas the indoor units D and E perform heating. When performing the heating main operation, the four-way switch valve 2 is switched so as to cause the refrigerant discharged from the compressor 1 to flow into the third branch section 10. The first solenoid valve 8*f*, the second solenoid valve 8*d*, and the third solenoid valve 8*e* are closed, whereas the first solenoid valve 8*c*, the second solenoid valve 8*g*, and the third solenoid valve 8*h* are opened. Furthermore, in order to reduce a pressure difference between the indoor unit C performing cooling and the heat-source-side heat exchanger 3, the opening degree of the third flow control device 22 is controlled so that it is completely opened, or the evaporating temperature of the refrigerant in the first connection pipe 6*c* is controlled to about 0 degrees C. In this state, the operation of the compressor 1 commences.

A low-temperature low-pressure gas refrigerant is compressed by the compressor 1 and is discharged therefrom as a high-temperature high-pressure gas refrigerant. The refrigerant compression process in the compressor 1 is expressed by a line extending from point (a) to point (b) in FIG. 10.

The high-temperature high-pressure gas refrigerant discharged from the compressor 1 flows into the third branch section 10 via the four-way switch valve 2, the check valve 20, and the second connection pipe 7. The high-temperature high-pressure gas refrigerant flowing into the third branch section 10 flows into the indoor heat exchangers 5*d* and 5*e* from the third branch section 10 via the solenoid valves 8*g* and 8*h* and the first connection pipes 6*d* and 6*e*. Then, the refrigerant is cooled while heating indoor air, thereby becoming an intermediate-temperature high-pressure liquid refrigerant. The change in the state of the refrigerant at the indoor heat exchangers 5*d* and 5*e* is expressed by a slightly-slanted substantially horizontal line extending from point (b) to point (c) in FIG. 10.

The intermediate-temperature high-pressure liquid refrigerant flowing out of the indoor heat exchangers 5*d* and 5*e* flows into the first flow control devices 9*d* and 9*e* and then merges at the fourth branch section 11 via the second connection pipes 7*d* and 7*e*. A portion of the high-pressure liquid refrigerant merging at the fourth branch section 11 flows into the first flow control device 9*c* provided in the indoor unit C, which performs cooling, via the second connection pipe 7*c*. The high-pressure liquid refrigerant flowing into the first flow control device 9*c* is expanded and reduced in pressure by the first flow control device 9*c*, thereby turning into a low-temperature low-pressure two-phase gas-liquid state. The change in the state of the refrigerant in this case is expressed by a vertical line extending from point (c) to point (d) in FIG. 10.

The low-temperature low-pressure two-phase gas-liquid refrigerant flowing out of the first flow control device 9*c* flows into the indoor heat exchanger 5*c*. The refrigerant is heated while cooling indoor air, thereby becoming a low-temperature low-pressure gas refrigerant. The change in the state of the refrigerant in this case is expressed by a slightly-slanted substantially horizontal line extending from point (d) to point (e) in FIG. 10. The refrigerant flowing out of the indoor heat exchanger 5*c* flows into the first connection pipe 6*c* and then flows into the first connection pipe 6 via the first solenoid valve 8*c* and the third branch section 10.

On the other hand, the remaining portion of the high-pressure liquid refrigerant flowing out of the indoor heat exchangers 5*d* and 5*e* and merging at the fourth branch section 11 via the second connection pipes 7*d* and 7*e* flows into the second bypass pipe 14*b* and then flows into the fifth flow control device 15. The high-pressure liquid refrigerant flowing into the fifth flow control device 15 is expanded (reduced in pressure) by the fifth flow control device 15, thereby turning into a low-temperature low-pressure two-phase gas-liquid state. The change in the state of the refrigerant in this case is expressed by a vertical line extending from point (c) to point (f) in FIG. 10.

The low-temperature low-pressure two-phase gas-liquid refrigerant flowing out of the fifth flow control device 15 flows into the first connection pipe 6 via the first heat exchanger 16 and the second heat exchanger 17 and merges with the low-temperature low-pressure two-phase gas-liquid refrigerant (vaporous refrigerant) flowing out of the indoor heat exchanger 5*c* (point (g)). The low-temperature low-pressure two-phase gas-liquid refrigerant merging in the first connection pipe 6 flows into the heat-source-side heat exchanger 3 via the check valve 21, the gas-liquid separator 25, the third heat exchanger 26, and the third flow control device 22. Then, the refrigerant absorbs heat from outdoor air, thereby becoming a low-temperature low-pressure gas refrigerant. The change in the state of the refrigerant in this case is expressed by a slightly-slanted substantially horizontal line extending from point (g) to point (a) in FIG. 10. The low-temperature low-pressure gas refrigerant flowing out of the heat-source-side heat exchanger 3 flows into the compressor 1 via the check valve 28, the four-way switch valve 2, and the accumulator 4 and is compressed.

When Injection is Performed During Heating Main Operation

Figure 11:
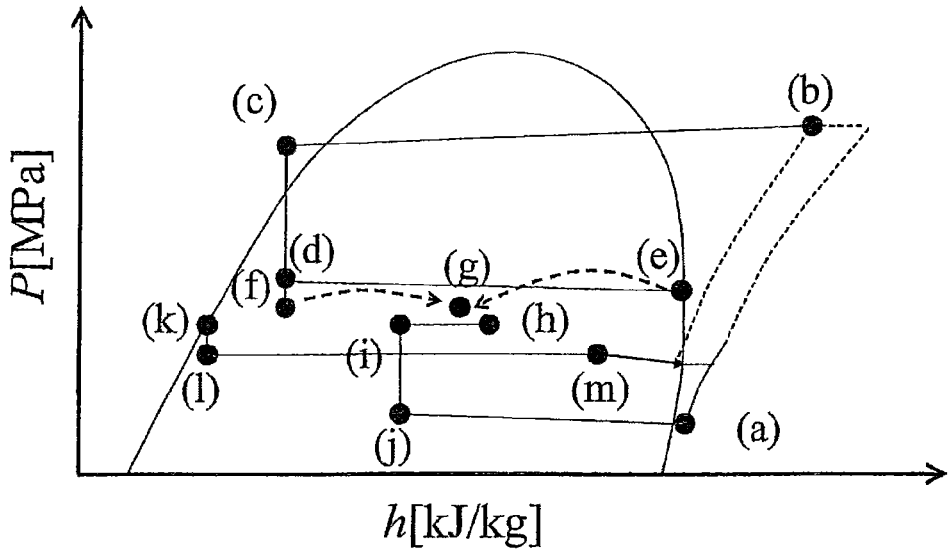
FIG. 11 is a P-h diagram corresponding to a case where the injection is performed during the heating main operation of the air-conditioning apparatus shown in FIG. 1.

FIG. 11 is a P-h diagram corresponding to a case where the injection is performed during the heating main operation of the air-conditioning apparatus 100 shown in FIG. 1. The following description based on FIGS. 1 and 11 relates to the case where the injection is performed during the heating main operation. The movement of the refrigerant when the discharge temperature may increase, unless an injection is performed, due to an increase in refrigerant compression ratio will be described. When performing the injection during the heating main operation, the solenoid valve 29 is closed. Because the flow of the mainstream refrigerant is basically similar to that when the injection is not performed, a description thereof will be omitted. Furthermore, in order to increase the pressure of the refrigerant to be injected into the compressor 1 and to ensure the capacity of the indoor unit C that performs cooling, the opening degree (expansion) of the third flow control device 22 is controlled such that the evaporating temperature of the refrigerant in the first connection pipe 6*c* is about 0 degrees C.

With regard to a two-phase gas-liquid refrigerant flowing into the gas-liquid separator 25 after circulating through the indoor units C to E, a portion of the refrigerant is diverted mainly in a liquid refrigerant state from one side of the gas-liquid separator 25 (point (k) in FIG. 11), whereas the remaining portion of the gas-phase refrigerant flows out of another outlet (point (h)). The mainstream refrigerant (point (h)) flowing out of this outlet is cooled at the third heat exchanger 26 (point (i)), is reduced in pressed by the third flow control device 22 (point (j)), and then flows into the heat-source-side heat exchanger 3.

On the other hand, the diverted liquid refrigerant (point (k)) is reduced in pressure by the flow control device 24 (point (l)), is heated at the third heat exchanger 26 (point (m)), and is injected into the compressor 1. By injecting a two-phase gas-liquid refrigerant into the compressor 1, the flow rate of the refrigerant increases so that the cooling capacity increases. Moreover, the discharge temperature of the compressor 1 is reduced. Because the liquid refrigerant is diverted at the gas-liquid separator 25, the refrigerant flowing into the flow control device 24 is a single-phase liquid refrigerant, and the refrigerant flowing into the third flow control device 22 is cooled at the third heat exchanger 26 so as to become a single-phase liquid refrigerant. In other words, since a single-phase liquid refrigerant flows into the second flow control device 24 and the third flow control device 22, the occurrence of a pressure fluctuation is suppressed. Specifically, the second flow control device 24 and the third flow control device 22 can perform stable flow control on the refrigerant.

In the above description, the refrigerant flowing into the third flow control device 22 is cooled at the third heat exchanger 26 so as to become a single-phase liquid refrigerant. However, depending on the condition of the refrigerant, the refrigerant may sometimes turn into a two-phase gas-liquid refrigerant instead of a single-phase liquid refrigerant. In that case, a device, such as a porous metallic material or a sintered pipe, which agitates and causes disturbance in the flow field of the two-phase gas-liquid flow, may be installed immediately in front of the third flow control device 22 so that more stable control can be performed. Because the flow in a pipe develops at about 10 to 20 times the inner diameter thereof, the agitating device may be installed at about five times or smaller of the inner diameter thereof from the third flow control device 22 so that an effect by the agitation can be achieved. Furthermore, the device that agitates and causes disturbance in the flow field of the two-phase gas-liquid flow may be applied to the second flow control device 24 and the fifth flow control device 15.

The air-conditioning apparatus 100 according to Embodiment 1 reduces the discharge temperature of the compressor 1 by performing the injection to the compressor 1 during the heating main operation in this manner so as to reduce deterioration of the refrigerant and the refrigerating machine oil and fatigue in the seal material, etc. of the compressor 1, thereby allowing for the stable (highly-reliable) operation of the compressor 1. Furthermore, during the heating main operation, the refrigerant is controlled to an intermediate pressure by being made to travel through the fifth flow control device 15. Then, the intermediate-pressure refrigerant is injected into the compressor 1, thereby allowing for the stable injection.

When Defrosting Operation is Performed

When the heat-source-side heat exchanger 3 functions as an evaporator, frost may form on fins and a tube of the heat-source-side heat exchanger 3. The air-conditioning apparatus 100 according to Embodiment 1 can remove such frost by performing a defrosting operation. This defrosting operation will be discussed below. In order to perform the defrosting operation efficiently, it is necessary to prevent heat radiation by reducing a temperature difference between the outdoor-air temperature and the temperature of the refrigerant and also to shorten the time for radiating heat to outdoor air by shortening the defrosting time.

When performing the defrosting operation, the connection of the four-way switch valve 2 is switched so that a high-temperature refrigerant discharged from the compressor 1 is supplied to the heat-source-side heat exchanger 3. Then, the refrigerant cooled at and flowing out of the heat-source-side heat exchanger 3 is supplied to the injection pipe 23 via the first branch section 40 so as to be injected into the compressor 1.

The air-conditioning apparatus 100 according to Embodiment 1 uses R32, a refrigerant mixture of R32 and HFO1234yf, or a refrigerant mixture of R32 and HFO1234ze. Therefore, as shown in FIG. 2, the discharge temperature of the compressor 1 increases, as compared with a case where an R410A refrigerant is used. Thus, it is effective to reduce the discharge temperature of the compressor 1 by performing the injection to increase the flow rate of the refrigerant so that the defrosting capacity is enhanced.

As described above, in the refrigerant circuit configuration of the air-conditioning apparatus 100 according to Embodiment 1, the injection can be performed regardless of whether the operation is the cooling operation, the heating operation, or the cooling and heating mixed operation. In other words, regardless of whether the operation is the cooling operation, the heating operation, or the cooling and heating mixed operation, the compressor 1 can be made to operate stably by reducing the discharge temperature of the compressor 1.

Furthermore, with the check valves 21, 27, and 28 provided, the refrigerant is made to flow into the third flow control device 22 only during the heating operation and the heating main operation. During the heating main operation, a decrease in outdoor-air temperature may sometimes cause the evaporating temperature for evaporating the refrigerant at the heat-source-side heat exchanger 3 to become lower than the evaporating temperature of an indoor heat exchanger provided in an indoor unit that performs cooling. In that case, the refrigerant flowing into the heat-source-side heat exchanger 3 can be reliably evaporated by performing pressure adjustment at the third flow control device 22.

On the other hand, during the cooling main operation, since the evaporating temperature for evaporating the refrigerant at the heat-source-side heat exchanger 3 does not become higher than the evaporating temperature of indoor units that perform cooling in reality, the pressure adjustment does not need to be performed. In other words, during the cooling main operation, pressure loss occurring in the process of the refrigerant flowing from indoor units performing cooling to the heat-source-side heat exchanger 3 is reduced so that the operation can be performed in a highly efficient state. Therefore, the pressure adjustment does not particularly need to be performed.

Embodiment 2

Figure 12:
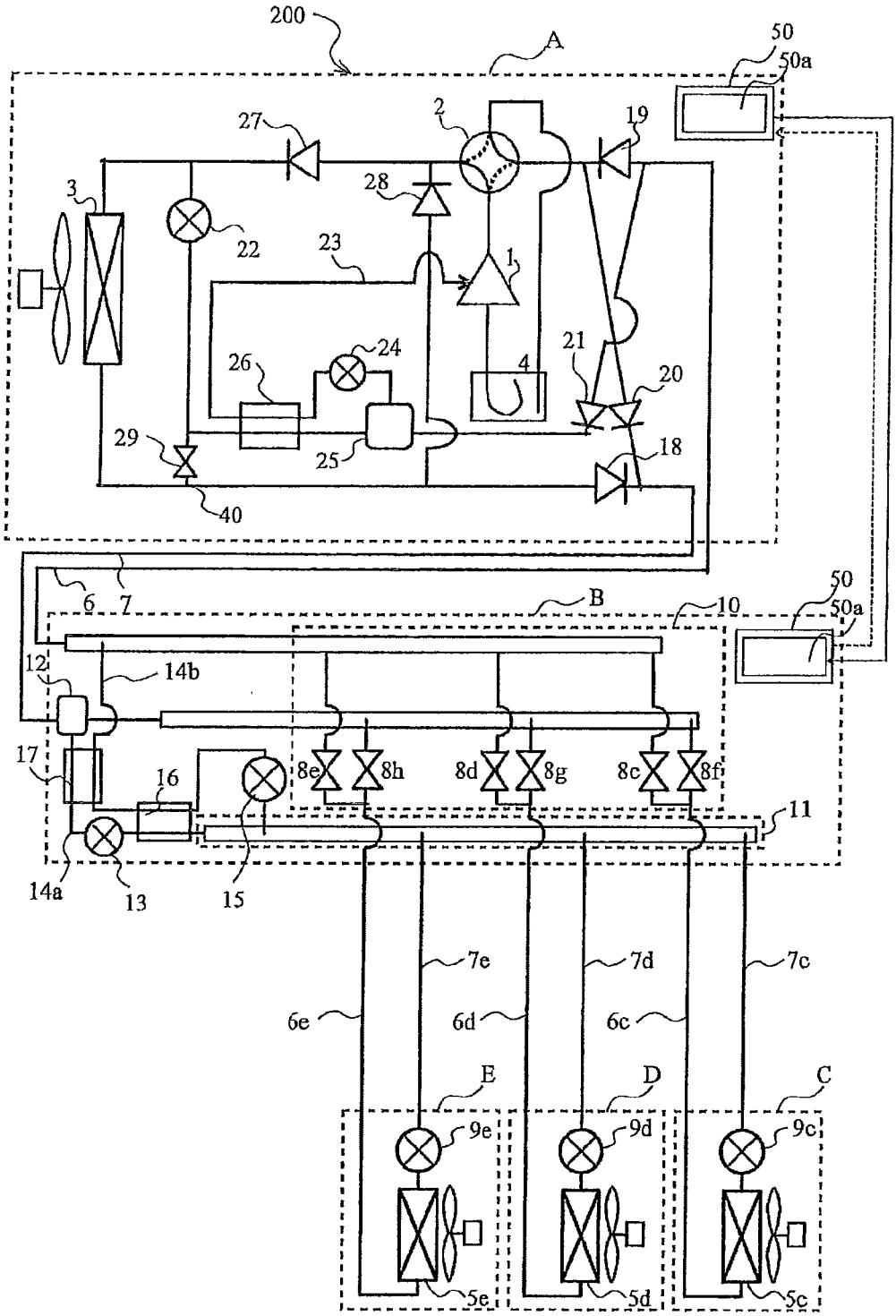
FIG. 12 is a refrigerant circuit diagram illustrating an example of a refrigerant circuit configuration of an air-conditioning apparatus according to Embodiment 2.

FIG. 12 is a refrigerant circuit diagram illustrating an example of a refrigerant circuit configuration of an air-conditioning apparatus 200 according to Embodiment 2. In Embodiment 2, sections that are the same as those in Embodiment 1 are given the same reference numerals or characters, and the following description will mainly be directed to different points from Embodiment 1. Similar to Embodiment 1, the first branch section 40 may be positioned in front of or behind the check valve 18 so long as the first branch section 40 is disposed in the pipe extending from the heat-source-side heat exchanger 3 to the second connection pipe 7. The air-conditioning apparatus 200 according to Embodiment 2 differs from the air-conditioning apparatus 100 according to Embodiment 1 in the extracting section of the injection pipe 23 extending out from the gas-liquid separator 25.

Specifically, in the air-conditioning apparatus 100 according Embodiment 1, when the injection is to be performed during the heating operation or the heating main operation, the refrigerant flowing into the injection pipe 23 after being separated at the gas-liquid separator 25 is a two-phase gas-liquid refrigerant. In contrast, when the injection is to be performed during the heating operation or the heating main operation in the air-conditioning apparatus 200 according to Embodiment 2, the refrigerant flowing into the injection pipe 23 after being separated at the gas-liquid separator 25 is mainly a gas refrigerant. Even in such an air-conditioning apparatus 200, the injection to the compressor 1 can be performed during the cooling operation, the heating operation, and the cooling and heating mixed operation. Specifically, the flow rate of the refrigerant increases so that the capacity for the cooling operation, the heating operation, and the cooling and heating mixed operation increases. Moreover, the discharge temperature of the compressor 1 is reduced.

Even though the bore diameter of the flow control device 24 is increased to make a gas refrigerant flow into the injection pipe 23, the gas-liquid separator 25 in the air-conditioning apparatus 200 according to Embodiment 2 causes a major portion of the gas in the two-phase refrigerant flowing into the gas-liquid separator 25 to be injected into the compressor 1, whereby the flow rate of the refrigerant flowing into the heat-source-side heat exchanger 3 can be reduced. Therefore, since the amount of refrigerant flowing out of the heat-source-side heat exchanger 3 decreases, the electric power (input) to be supplied to the compressor 1 can be reduced correspondingly. In this case, there is no problem with removing the third heat exchanger 26.

Embodiment 3

Figure 13:
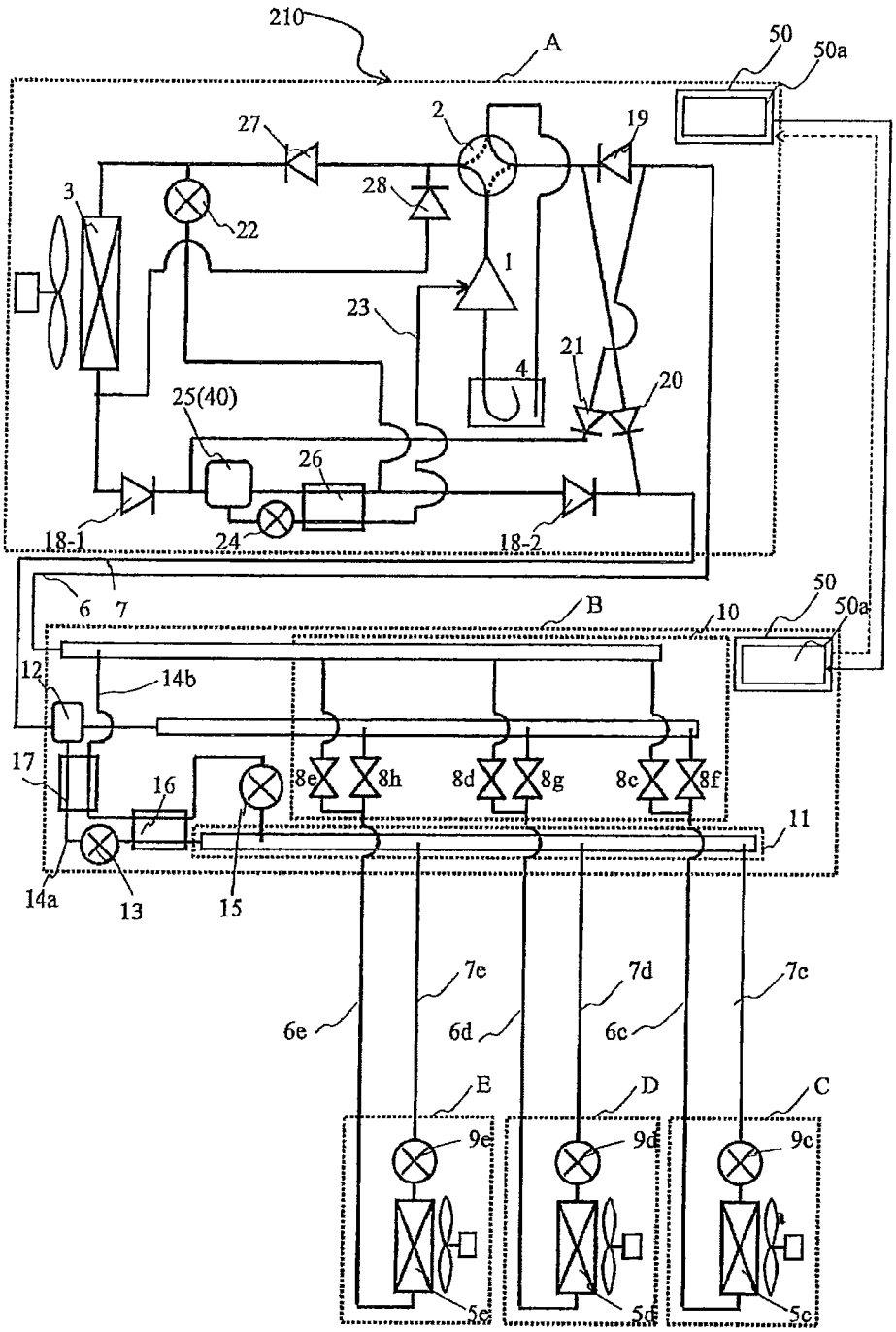
FIG. 13 is a refrigerant circuit diagram illustrating an example of a refrigerant circuit configuration of an air-conditioning apparatus according to Embodiment 3.

FIG. 13 is a refrigerant circuit diagram illustrating an example of a refrigerant circuit configuration of an air-conditioning apparatus 210 according to Embodiment 3. In Embodiment 3, sections that are the same as those in Embodiment 1 are given the same reference numerals or characters, and the following description will mainly be directed to different points from Embodiment 1.

In the air-conditioning apparatus 210 according to Embodiment 3, the mainstream refrigerant travels through the gas-liquid separator 25 and the third heat exchanger 26 during cooling. In detail, a check valve 18-1 and a check valve 18-2 are connected in series in an area corresponding to the check valve 18 in Embodiment 1, and the gas-liquid separator 25, the third heat exchanger 26, the third flow control device 22, and the injection pipe 23 are connected to a pipe extending between the two check valves. Furthermore, in the inflow-side pipe extending into the gas-liquid separator 25, the check valve 21 is connected in parallel to the check valve 18-1. In the outflow-side pipe extending out from the third heat exchanger 26 (but not the injection pipe 23), the third flow control device 22 is connected in parallel to the check valve 18-2. The solenoid valve 29 used in Embodiment 1 and Embodiment 2 is not provided. Furthermore, the first branch section 40 and the gas-liquid separator (second branch section) 25 are the same section of the refrigerant circuit shown in FIG. 1.

Because the air-conditioning apparatus 210 according to Embodiment 3 is provided with the check valve 18-1 and the check valve 18-2, the flow of the refrigerant during the heating operation and the heating main operation is the same as that in Embodiment 1. Moreover, the refrigerant is separated into gas and liquid at the first branch section 40 during the cooling operation and the cooling main operation. The liquid-phase portion of the refrigerant separated into gas and liquid is reduced in pressure by the second flow control device 24, is gasified at the third heat exchanger 26, and is injected into the compressor 1. The mainstream refrigerant (i.e., the gas-phase portion of the refrigerant separated into gas and liquid) is cooled at the third heat exchanger 26.

According to this configuration, the mainstream refrigerant is liquefied, and the refrigerant flowing into the second flow control device 24 is maintained in a single-phase liquid state, thereby allowing for more stable injection operation. Furthermore, the solenoid valve used in Embodiment 1 and Embodiment 2 can be omitted. Moreover, the mainstream refrigerant can be cooled so that the cooling capacity increases.

Embodiment 4

Figure 14:
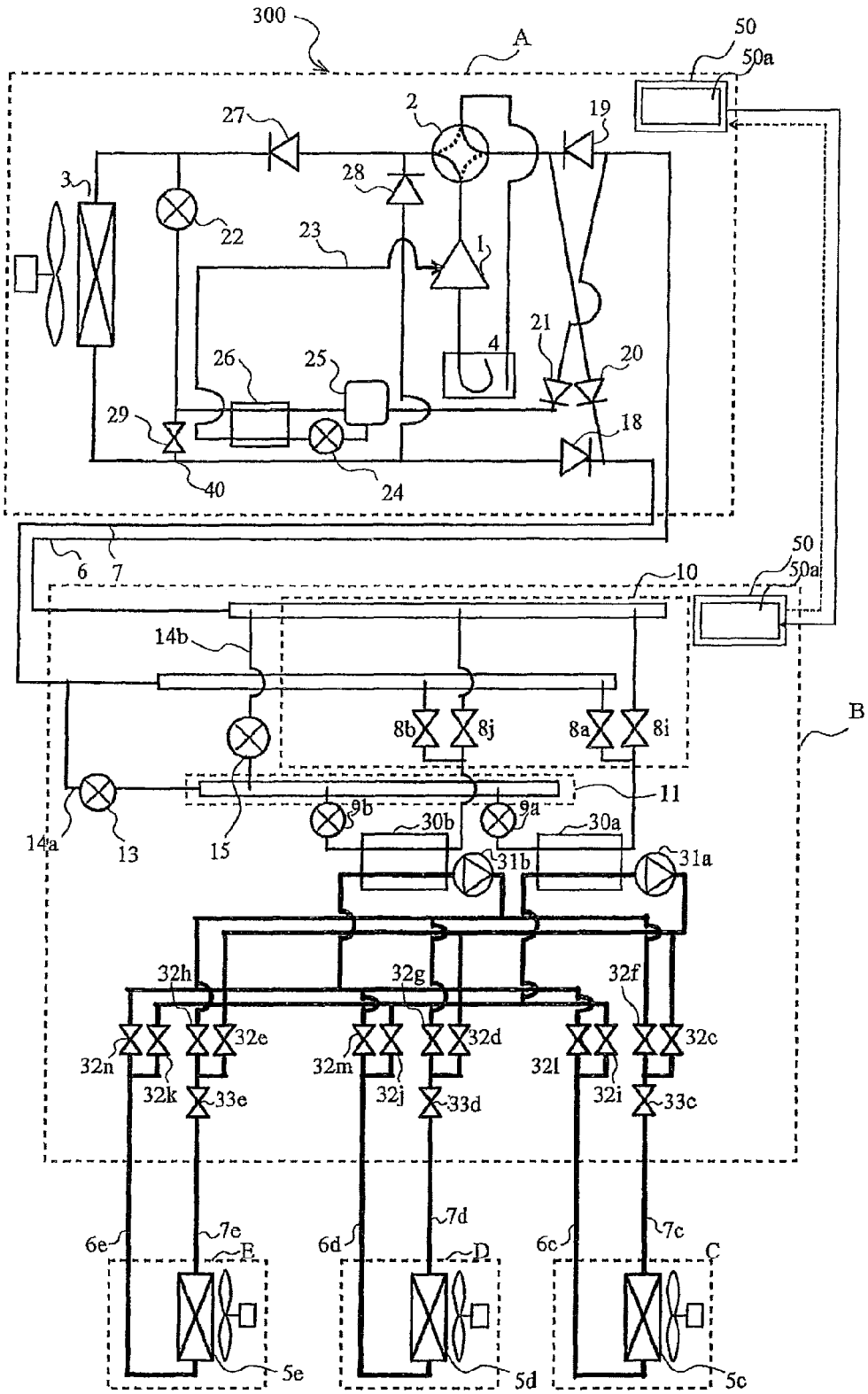
FIG. 14 is a refrigerant circuit diagram illustrating an example of a refrigerant circuit configuration of an air-conditioning apparatus according to Embodiment 4.

FIG. 14 is a refrigerant circuit diagram illustrating an example of a refrigerant circuit configuration of an air-conditioning apparatus 300 according to Embodiment 4. In Embodiment 4, sections that are the same as those in Embodiment 1 are given the same reference numerals or characters, and the following description will mainly be directed to different points from Embodiment 1. Furthermore, there is no problem with the circuit configuration in the outdoor unit being made similarly to that in Embodiment 2 or Embodiment 3.

In the air-conditioning apparatus 300 according to Embodiment 4, intermediate heat exchangers 30*a* and 30*b*, first flow control devices 9*a* and 9*b*, and pumps 31*a* and 31*b* are installed in the relay unit B. The first heat exchanger 16 and the second heat exchanger 17 used in Embodiment 1, Embodiment 2, and Embodiment 3 are not provided.

In the relay unit B, solenoid valves 32*c* to 32*h* that select the connections between the second connection pipes 7*c* to 7*e* of the indoor units C to E and the intermediate heat exchangers 30*a* and 30*b* are installed. Furthermore, solenoid valves 32*i* to 32*n* that select the connections between the first connection pipes 6*c* to 6*e* of the indoor units C to E and the intermediate heat exchangers 30*a* and 30*b* are installed. Moreover, flow control devices 33*c* to 33*e* that adjust the flow rate of brine flowing into the indoor units C to E are installed between the solenoid valves 32*c* to 32*h* and the indoor units C to E.

Although two intermediate heat exchangers 30*a* and 30*b* are described as an example here, the number thereof is not limited. Any number of intermediate heat exchangers may be installed so long as a second refrigerant can be cooled and/or heated. Moreover, the number of each of the pumps 31*a* and 31*b* is not limited to one. A plurality of low-capacity parallel-arranged or series-arranged pumps may be used.

In the intermediate heat exchangers 30*a* and 30*b*, the refrigerant exchanges heat with brine driven by the pumps 31*a* and 31*b* so that hot water or cold water is produced. The brine used may be antifreeze, water, a liquid mixture of water and antifreeze, or a liquid mixture of water and a highly-anticorrosive additive. The brine flows through thick-line sections shown in FIG. 14.

Heat transport from the intermediate heat exchangers 30*a* and 30*b* to the indoor units C to E is performed by the brine. Specifically, the brine exchanges heat with the refrigerant from the heat source unit A at the intermediate heat exchangers 30*a* and 30*b* so as to be heated or cooled. Then, the pumps 31*a* and 31*b* supply the heated or cooled brine to the indoor units C to E via the second connection pipes 7*c* to 7*e*. The heat of the brine supplied to the indoor units C to E is used for heating or cooling by the indoor heat exchangers 5*c* to 5*e*. The brine flowing out of the indoor heat exchangers 5*c* to 5*e* returns to the relay unit B via the first connection pipes 6*c* to 6*e*. Because the brine flowing through the second connection pipes 7*c* to 7*e* and the brine flowing through the first connection pipes 6*c* to 6*e* have substantially the same density, the pipes may have the same thickness.

In the cooling operation in which all of the indoor units C to E perform cooling, the intermediate heat exchangers 30*a* and 30*b* function as evaporators for producing cold water. A P-h diagram for the refrigeration-cycle side (heat-source-unit side) in this case is the same as that in FIG. 3 when the injection is not performed, and is the same as that in FIG. 4 when the injection is performed. On the other hand, in the heating operation in which all of the indoor units C to E perform heating, the intermediate heat exchangers 30*a* and 30*b* function as radiators for producing hot water. A P-h diagram for the refrigeration-cycle side (heat-source-unit side) in this case is the same as that in FIG. 6 when the injection is not performed, and is the same as that in FIG. 7 when the injection is performed.

Furthermore, when performing the cooling and heating mixed operation in which the indoor units perform the cooling operation and the heating operation in a mixed fashion at the same time, one of the intermediate heat exchangers 30*a* and 30*b* functions as an evaporator to produce cold water, whereas the other intermediate heat exchanger functions as a condenser to produce hot water. In this case, the cooling main operation or the heating main operation is performed by switching the connection of the four-way switch valve 2 and performing selection for making the heat-source-side heat exchanger 3 function as an evaporator or a radiator in accordance with the ratio between the cooling load and the heating load. A P-h diagram for the refrigeration-cycle side (heat-source-unit side) in this case is the same as that in FIG. 8 when the injection is not performed in the cooling main operation, and is the same as that in FIG. 9 when the injection is performed. Furthermore, a P-h diagram for the refrigeration-cycle side (heat-source-unit side) is the same as that in FIG. 10 when the injection is not performed in the heating main operation, and is the same as that in FIG. 11 when the injection is performed. In other words, the operation at the refrigeration-cycle side is substantially the same as that in Embodiment 1.

In the air-conditioning apparatus 300 according to Embodiment 4, the flow of the refrigerant can be conceived as being similar to that in Embodiment 1 by considering that the sections corresponding to the indoor heat exchangers 5*c* to 5*e* in Embodiment 1 are replaced by the intermediate heat exchangers 30*a* and 30*b*. In addition, a circulation circuit that circulates the second refrigerant, such as brine, is formed by connecting the pumps 31*a* and 31*b*, the indoor heat exchangers 5*c* to 5*e*, and the intermediate heat exchangers 30*a* and 30*b*, and the indoor heat exchangers 5*c* to 5*e* exchange heat between the second refrigerant and indoor air. Therefore, even if the refrigerant leaks from a pipe, the refrigerant can be prevented from entering the air-conditioned space, whereby a safe air-conditioning apparatus can be obtained.

Furthermore, when the heat transport from the relay unit B to the indoor units C to E is performed by using a refrigerant, as in the air-conditioning apparatus 100 according to Embodiment 1 and the air-conditioning apparatus 200 according to Embodiment 2, the first flow control devices 9*c* to 9*e* are installed near the indoor heat exchangers 5*c* to 5*e*.

In contrast, when the heat transport is performed by using brine, as in the air-conditioning apparatus 300 according to Embodiment 4, a change in the temperature of the brine caused by pressure loss in the first connection pipes 6*c* to 6*e* and the second connection pipes 7*c* to 7*e* is reduced. Thus, the flow control devices 33*c* to 33*e* can be installed within the relay unit B. By installing the flow control devices 33*c* to 33*e* within the relay unit B in this manner, the flow control devices 33*c* to 33*e* can be disposed away from the indoor air-conditioned space, whereby noise toward the indoor units, such as noise created when the valves of the flow control devices 33*c* to 33*e* are driven or when the refrigerant flows through the valves, can be reduced.

Furthermore, since the flow control can be performed collectively in the relay unit B, the control in the indoor units C to E only involves controlling fans based on information, such as the condition of an indoor remote controller, a thermostat-off state, and information indicating whether the outdoor unit is performing defrosting.

Moreover, by using a refrigerant for the heat transport from the heat source unit A to the relay unit B, the pumps used for driving the brine can be made compact so that the power used for transporting the brine can be further reduced, thereby achieving energy conservation.

In the refrigerant circuit configuration of the air-conditioning apparatus 300 according to Embodiment 4, the cooling and heating capacity can be enhanced by performing an injection to the compressor 1 via the injection pipe 23, as in the air-conditioning apparatus 100 according to Embodiment 1. Thus, the discharge temperature of the compressor 1 can be reduced. The reduced discharge temperature of the compressor 1 allows for a stable operation of the compressor 1.

REFERENCE SIGNS LIST

1 compressor 2 four-way switch valve 3 heat-source-side heat exchanger 4 accumulator 5*c* to 5*e* indoor heat exchanger 6 first connection pipe 6*c* to 6*e* first connection pipe 7 second connection pipe 7*c* to 7*e* second connection pipe 8*c* solenoid valve 9 first flow control device 9*a*, 9*b* first flow control device 9*c* to 9*e* first flow control device third branch section 11 fourth branch section 12 gas-liquid separator 13 fourth flow control device 14 bypass pipe 14*a* first bypass pipe 14*b* second bypass pipe 15 fifth flow control device 16 first heat exchanger 17 second heat exchanger 18 to 21, 18-1, 18-2 check valve third flow control device 23 injection pipe 24 second flow control device 25 gas-liquid separator (second branch section) 26 third heat exchanger 27, 28 check valve 29 solenoid valve 30*a*, 30*b* intermediate heat exchanger 31*a*, 31*b* pump 32*c* to 32*n* solenoid valve 33*c* to 33*e* flow control device 40 first branch section 100, 200, 210, 300 air-conditioning apparatus A heat source unit (outdoor unit) B relay unit C to E indoor unit

The invention claimed is:

1. An air-conditioning apparatus comprising:

a shell-structure compressor including a compression chamber that is provided within a sealed container;

a flow switching valve connected to the compressor;

a heat-source-side heat exchanger connected to the flow switching valve and functions as a radiator or an evaporator;

a plurality of use-side heat exchangers each communicate with the flow switching valve and function as evaporators or radiators;

a plurality of first flow control devices connected to the plurality of use-side heat exchangers, respectively;

an injection pipe having one end connected to a downstream side of the radiator and the other end connected to the compression chamber of the compressor;

a second flow control device provided in the injection pipe for controlling an injection amount of refrigerant to be supplied to the compression chamber;

a third flow control device for controlling a pressure of the refrigerant to an intermediate pressure, the intermediate pressure being lower than a high pressure of the refrigerant being discharged from the compressor and being higher than a low pressure of the refrigerant being suctioned into the compressor;

a refrigerant circuit for circulating the refrigerant through one of the use-side heat exchangers, at least one of the first flow control devices, and a heat source unit, the heat source unit being installed outdoors and including the shell-structure compressor, the flow switching valve, the heat-source-side heat exchanger, the injection pipe, the second flow control device, and the third flow control device; and a controller that controls the flow switching valve, the first flow control devices, the second flow control device and the third flow control device, wherein the controller is configured to operate in a heating operation in which the heat-source-side heat exchanger functions as the evaporator and the use-side heat exchangers function as the radiators, a heating main operation in which the heat-source-side heat exchanger and one or more of the use-side heat exchangers function as the evaporators and the rest of the use-side heat exchangers functions as the radiator, and in which a heating load is greater than a cooling load, a cooling operation in which the heat-source-side heat exchanger functions as the radiator and the use-side heat exchangers function as the evaporators, and a cooling main operation in which the heat-source-side heat exchanger and one or more of the use-side heat exchangers function as the radiators and the rest of the use-side heat exchangers functions as the evaporator, wherein the controller switches the flow switching valve into a first position to operate in the heating operation and the heating main operation and into a second position to operate in the cooling operation and the cooling main operation, wherein the refrigerant circuit includes a first flow path provided in the heat source unit through which the refrigerant flowing from the heat-source-side heat exchanger to an outlet of the heat source unit flows during the cooling operation and the cooling main operation, a second flow path provided in the heat source unit through which the refrigerant flowing from an inlet of the heat source unit to the heat-source-side heat exchanger flows during the heating operation and the heating main operation, the second flow path being connected to the first flow path and including the third flow control device, and a valve provided in the heat source unit for preventing the refrigerant flowing in the second flow path from flowing into the heat-source-side heat exchanger via the first flow path during the heating operation and the heating main operation, wherein during the cooling operation and the cooling main operation, the first flow control devices are opened and the third flow control device is closed, and the refrigerant flowing out from the heat-source-side heat exchanger flows sequentially through the first flow control device of the plurality of first flow control devices corresponding to the evaporator and respective evaporator without traveling through the third flow control device, wherein when the refrigerant is supplied to the compression chamber via the injection pipe during the cooling operation and the cooling main operation, the first flow control devices and the second flow control device are opened and the third flow control device is closed, wherein during the heating operation and the heating main operation, the first flow control devices and the third flow control device are opened, and the refrigerant flowing out from the radiator flows sequentially through the first flow control device of the plurality of first flow control devices corresponding to the radiator, the third flow control device and the heat-source-side heat exchanger, wherein when the refrigerant is supplied to the compression chamber via the injection pipe during the heating operation and the heating main operation, the first flow control devices, the second flow control device and the third flow control device are opened, and wherein during the cooling operation and the cooling main operation the refrigerant flowing into the injection pipe includes the refrigerant flowing out of the heat-source-side heat exchanger, and during the heating operation and the heating main operation the refrigerant flowing into the injection pipe includes the refrigerant flowing into the heat source unit before flowing into the third flow control device.

2. The air-conditioning apparatus of claim 1, further comprising:

a first branch section provided at a downstream side of the heat-source-side heat exchanger and having one side that branches off to the use-side heat exchangers and another side that branches off to the injection pipe; and a heat exchanging unit that causes the refrigerant flowing from the heat-source-side heat exchanger via the first branch section to exchange heat with the refrigerant having passed through the second flow control device, wherein when the heat-source-side heat exchanger operates as a condenser, the refrigerant discharged from the compressor flows sequentially through the heat-source-side heat exchanger, the first branch section, the second flow control device, and the heat exchanging unit so as to be injected into the compressor.

3. The air-conditioning apparatus of claim 2, further comprising:

a second branch section provided between the third flow control device and the use-side heat exchangers and having one side that branches off to the third flow control device and another side that branches off to the injection pipe; and the heat exchanging unit that causes the refrigerant flowing via the second branch section to exchange heat with the refrigerant having passed through the second flow control device, wherein when the heat-source-side heat exchanger operates as an evaporator, the refrigerant discharged from the compressor flows sequentially through one or more of the use-side heat exchangers in which a load is generated, the first flow control device, the second branch section, the second flow control device, and the heat exchanging unit so as to be injected into the compressor.

4. The air-conditioning apparatus of claim 3, wherein the second branch section is provided with a gas-liquid separator, wherein a liquid-phase refrigerant is mainly supplied to the injection pipe, and a gas-phase refrigerant is mainly supplied to the heat-source-side heat exchanger, and wherein the liquid-phase refrigerant to be mainly supplied to the injection pipe and the gas-phase refrigerant to be mainly supplied to the heat-source-side heat exchanger exchange heat with each other at the heat exchanging unit.

5. The air-conditioning apparatus of claim 3, wherein the second branch section is provided with a gas-liquid separator, wherein a gas-phase refrigerant is mainly supplied to the injection pipe, and a liquid-phase refrigerant is mainly supplied to the heat-source-side heat exchanger, and wherein the gas-phase refrigerant to be mainly supplied to the injection pipe and the liquid-phase refrigerant to be mainly supplied to the heat-source-side heat exchanger exchange heat with each other at the heat exchanging unit.

6. The air-conditioning apparatus of claim 3, wherein the first branch section and the second branch section are the same section.

7. The air-conditioning apparatus of claim 2, wherein when a defrosting operation of the heat-source-side heat exchanger is to be performed, the connection of the first flow switching valve is switched so that a high-temperature refrigerant discharged from the compressor is supplied to the heat-source-side heat exchanger, and the refrigerant cooled at and flowing out of the heat-source-side heat exchanger is supplied to the injection pipe via the first branch section so as to be injected into the compressor.

8. The air-conditioning apparatus of claim 1, wherein the third flow control device is provided with refrigerant agitating means for mixing a single-phase liquid refrigerant and a two-phase gas-liquid refrigerant.

9. The air-conditioning apparatus of claim 1, wherein R32, a refrigerant mixture containing R32 and HFO1234yf and in which the R32 has a mass percentage of 40% or higher, or a refrigerant mixture containing R32 and HFO1234ze and in which the R32 has a mass percentage of 15% or higher, is used as a heat-source refrigerant.

* * * * *